US010968792B2

(12) United States Patent
Iwama et al.

(10) Patent No.: US 10,968,792 B2
(45) Date of Patent: Apr. 6, 2021

(54) MOTORCYCLE ENGINE

(71) Applicant: HONDA MOTOR CO., LTD., Tokyo (JP)

(72) Inventors: Takahiro Iwama, Wako (JP); Dai Kataoka, Wako (JP); Yuichi Tawarada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 7 days.

(21) Appl. No.: 16/364,670

(22) Filed: Mar. 26, 2019

(65) Prior Publication Data

US 2019/0301317 A1 Oct. 3, 2019

(30) Foreign Application Priority Data

Mar. 29, 2018 (JP) ..... JP2018-065351

(51) Int. Cl.
*F01M 9/10* (2006.01)
*F01M 11/00* (2006.01)
*F01L 13/00* (2006.01)

(52) U.S. Cl.
CPC ..... *F01M 9/105* (2013.01); *F01L 13/0036* (2013.01); *F01M 9/108* (2013.01);
(Continued)

(58) Field of Classification Search
CPC ..... F01M 9/10; F01M 11/02; F01M 9/102; F01M 1/06; F01M 11/062; F01M 1/16; F01M 9/105; F01L 1/267; F01L 2810/02
(Continued)

(56) References Cited

U.S. PATENT DOCUMENTS 3,824,973 A * 7/1974 Harhaus ..... F01M 9/10 123/90.34
5,195,472 A * 3/1993 Jacques ..... F01L 1/0532 123/196 M
(Continued)

FOREIGN PATENT DOCUMENTS

CN 107246311 A 10/2017
JP 03286113 A * 12/1991 ..... F01M 1/16
(Continued)

OTHER PUBLICATIONS

WO-2015163252,Apr. 17, 2015, English Language Machine Translation.*
(Continued)

*Primary Examiner* — Patrick Hamo
*Assistant Examiner* — Wesley G Harris
(74) *Attorney, Agent, or Firm* — Carrier Blackman & Associates, P.C.; William D. Blackman; Joseph P. Carrier

(57) ABSTRACT

An engine oil passage structure for an engine contributing to downsizing the engine and achieving protection of an oil passage against external forces is provided. Provided is an oil passage structure for an engine installed in a small vehicle, the engine including an engine body formed of a crankcase and a cylinder block and a cylinder head stacked inclined vehicle frontward on the crankcase, the crankcase, the cylinder block, and the cylinder head being integrally fastened. The oil passage structure includes, near a bent part formed by a case front wall of the crankcase and a cylinder front wall of the cylinder block forming a valley part by an obtuse angle, a right-left direction oil passage extending in a right-left direction along the valley part.

10 Claims, 31 Drawing Sheets

(52) U.S. Cl.
CPC .. *F01M 11/0004* (2013.01); *F01L 2013/0052* (2013.01); *F01M 2011/0033* (2013.01)

(58) Field of Classification Search
USPC ..... 123/90.34, 90.38
See application file for complete search history.

(56) References Cited

U.S. PATENT DOCUMENTS 5,507,259 A * 4/1996 Tanaka ..... F01M 9/106 123/193.5
5,601,057 A * 2/1997 Treyz ..... F01L 1/267 123/193.5
5,666,915 A 9/1997 Kawashima et al.
5,950,763 A * 9/1999 Ohta ..... F01M 11/02 123/196 R
6,367,441 B1 * 4/2002 Hoshiba ..... F01M 11/02 123/196 R
7,007,648 B2 3/2006 Fujikubo
2004/0069260 A1 4/2004 Fujikubo
2006/0065218 A1 * 3/2006 Gokan ..... F01P 9/00 123/41.82 R
2015/0114336 A1 * 4/2015 Matsuda ..... F01M 1/02 123/196 A

FOREIGN PATENT DOCUMENTS

JP 3954941 B2 8/2007
WO WO-2015163252 A1 * 10/2015 ..... F01L 13/0036

OTHER PUBLICATIONS

Office Action dated Nov. 11, 2020 issued in the corresponding Indian Patent Application No. 201914004567.

* cited by examiner

MOTORCYCLE ENGINE

BACKGROUND

1. Technical Field

The present invention relates to an oil passage structure for an engine installed in a small vehicle, which oil passage structure includes an oil passage for supplying oil to a valve gear provided at a cylinder head.

2. Description of the Background

In an engine including an engine body formed of a crankcase, a cylinder block provided obliquely upward on the crankcase, and a cylinder head stacked on the cylinder block so as to be inclined vehicle frontward, the crankcase, the cylinder block, and cylinder head being integrally fastened, an oil passage for supplying oil to a valve gear provided at the cylinder head is normally provided along the wall surface of the engine body (for example, see Patent Literature 1).

CITATION LIST

Patent Literature

[PATENT LITERATURE 1] Japanese Patent No. 3954941

Patent Literature 1 discloses an engine including an engine body including an oil passage for supplying oil, from a crankcase, through a cylinder block, to a bearing surface of a bearing wall at a cylinder head pivotally supporting a camshaft.

The oil passage in the crankcase and the cylinder block is formed to extend in the top-bottom direction at the front wall of the crankcase and that of the cylinder block.

In order to be reduced in size and weight, an engine installed in a small vehicle faces limited thickness of the front wall, the rear wall, and the right and left side walls of its engine body.

In the structure as disclosed in Patent Literature 1 in which the oil passage extends in the top-bottom direction at the front wall of the crankcase and that of the cylinder block, the oil passage bulges on the front side of the front wall, contrary to downsizing the engine.

Additionally, the oil passage bulging on the front side of the front wall fails to be protected against any external forces.

BRIEF SUMMARY

The present invention has been made in view of the foregoing, and an object thereof is to provide an oil passage structure for an engine contributing to downsizing the engine, and achieving protection of an oil passage against any external forces.

In order to achieve the object stated above, an oil passage structure for an engine of the present invention provides: an oil passage structure for an engine installed in a small vehicle, the engine including an engine body formed of a crankcase and a cylinder block and a cylinder head stacked inclined vehicle frontward on the crankcase, the crankcase, the cylinder block, and the cylinder head being integrally fastened, the engine body including an oil passage for supplying oil to a valve gear provided at the cylinder head, the oil passage structure including, near a bent part formed by a case front wall of the crankcase and a cylinder front wall of the cylinder block forming a valley part by an obtuse angle, a right-left direction oil passage extending in a right-left direction along the valley part.

In this structure, in an engine including an engine body formed of a crankcase and a cylinder block and a cylinder head stacked inclined vehicle frontward on the crankcase, the crankcase, the cylinder block, and the cylinder head being integrally fastened, near a bent part formed by a case front wall of the crankcase and a cylinder front wall of the cylinder block forming a valley part by an obtuse angle, a right-left direction oil passage extending in a right-left direction along the valley part is provided. Thus, the right-left direction oil passage is formed in a compact manner snugly along the valley part, contributing to downsizing the engine. Additionally, by virtue of the right-left direction oil passage being concealed in the valley part, the oil passage is protected against any external forces such as a stone thrown up by other vehicle.

In the above-described structure, the right-left direction oil passage may be formed at the case front wall.

In this structure, the right-left direction oil passage is formed at the case front wall of the crankcase. Therefore, protection against external forces improves than when the right-left direction oil passage is formed at the cylinder front wall of the cylinder block which is inclined frontward.

The above-described structure may further include a return oil passage for returning oil from the cylinder head to an oil pan provided below the crankcase, the return oil passage being formed to extend in a top-bottom direction at the front wall of the engine body. The right-left direction oil passage may be positioned inner than the return oil passage at the front wall.

In this structure, the right-left direction oil passage is positioned on the inner side (the rear side) in the front wall than the return oil passage formed to extend in the top-bottom direction at the front wall of the engine body. Therefore, the right-left direction oil passage is not formed to bulge at the front surface of the front wall, contributing to downsizing the engine.

The above-described structure may further include a front-rear direction oil passage formed to extend in a front-rear direction at one of right and left side walls of the engine body. The front-rear direction oil passage may be an outer piping where an oil passage pipe forming the front-rear direction oil passage is exposed outside.

In this structure, the front-rear direction oil passage formed to extend in a front-rear direction at one of right and left side walls of the engine body is an outer piping where the oil passage pipe forming the front-rear direction oil passage is exposed outside. Therefore, the oil cooling effect is exhibited.

In the above-described structure, the front-rear direction oil passage may be formed at a side wall of the engine body on an opposite side in the front-rear direction relative to a side wall where a cam chain is provided.

In this structure, at the side wall of the engine body where the cam chain is provided, a cam chain chamber where the cam chain is provided is formed. Thus, the front-rear direction oil passage is formed at the side wall of the engine body on the opposite side in the front-rear direction relative to the side wall where the cam chain is provided. This prevents an increase in size of the side wall where the cam chain is provided attributed to the front-rear direction oil passage, which may otherwise increase the volume of the engine body on one of the right and left sides. Thus, the engine body attains the laterally balanced structure.

The above-described structure may further include, at one of the right and left side walls of the engine body, a body top-bottom direction oil passage formed to extend in a top-bottom direction along a surface of the side wall.

In this structure, at one of the right and left side walls of the engine body, a body top-bottom direction oil passage extending in the top-bottom direction is formed along the surface of the side wall. Thus, the side wall of the engine body is effectively used in forming the body top-bottom direction oil passage, contributing to downsizing the engine.

In the above-described structure, the body top-bottom direction oil passage may be formed at a side wall of the engine body on an opposite side in the right-left direction relative to the side wall where the cam chain is provided.

At the side wall of the engine body where the cam chain is provided, a cam chain chamber where the cam chain is provided is formed. Therefore, the body top-bottom direction oil passage is formed at the at the side wall of the engine body on the opposite side in the front-rear direction relative to the side wall where the cam chain is provided. This prevents an increase in size of the side wall where the cam chain is provided attributed to the body top-bottom direction oil passage, which may otherwise increase the volume of the engine body on one of the right and left sides.

In the above-described structure, the valve gear may include a camshaft oriented in a right-left vehicle width direction and rotatably provided at the cylinder head, a cam carrier as a cylindrical member axially slidably fitting to an outer circumference of the camshaft while prohibited from relatively rotating, a plurality of cam lobes being different in cam profile from each other being formed axially adjacent to each other in an outer circumferential surface of the cam carrier, and a cam switch mechanism axially shifting the cam carrier to switch the cam lobes acting on a valve. The oil passage supplying oil to the valve gear may be an oil passage that supplies oil to an actuator of the cam switch mechanism. The oil passage structure may further include a head top-bottom direction oil passage formed to extend in the top-bottom direction at the side wall of the cylinder head, and the head top-bottom direction oil passage may be provided between a pair of supply and discharge oil passages supplying and discharging oil to and from the actuator.

In this structure, the valve gear is a variable valve gear which includes the camshaft, the cam carrier, and the cam switch mechanism. In the oil passage which supplies oil to the actuator of the cam switch mechanism, the head top-bottom direction oil passage formed to extend in the top-bottom direction at the side wall of the cylinder head is provided between a pair of oil passages which supplies and discharges oil to and from the actuator. Thus, the space between the pair of oil passages supplying and discharging oil to and from the actuator is effectively used in disposing the head top-bottom direction oil passage, contributing to downsizing the engine.

According to the present invention, in an engine including an engine body formed of a crankcase and a cylinder block and a cylinder head stacked inclined vehicle frontward on the crankcase, the crankcase, the cylinder block, and the cylinder head being integrally fastened, near a bent part formed by a case front wall of the crankcase and a cylinder front wall of the cylinder block forming a valley part by an obtuse angle, a right-left direction oil passage extending in a right-left direction along the valley part is provided. Thus, the right-left direction oil passage is formed in a compact manner snugly along the valley part, contributing to downsizing the engine. Additionally, by virtue of the right-left direction oil passage being concealed in the valley part, the oil passage is protected against any external forces such as a stone thrown up by other vehicle.

DETAILED DESCRIPTION

In the following, with reference to the drawings, a description will be given of an embodiment of the present invention.

Figure 1:
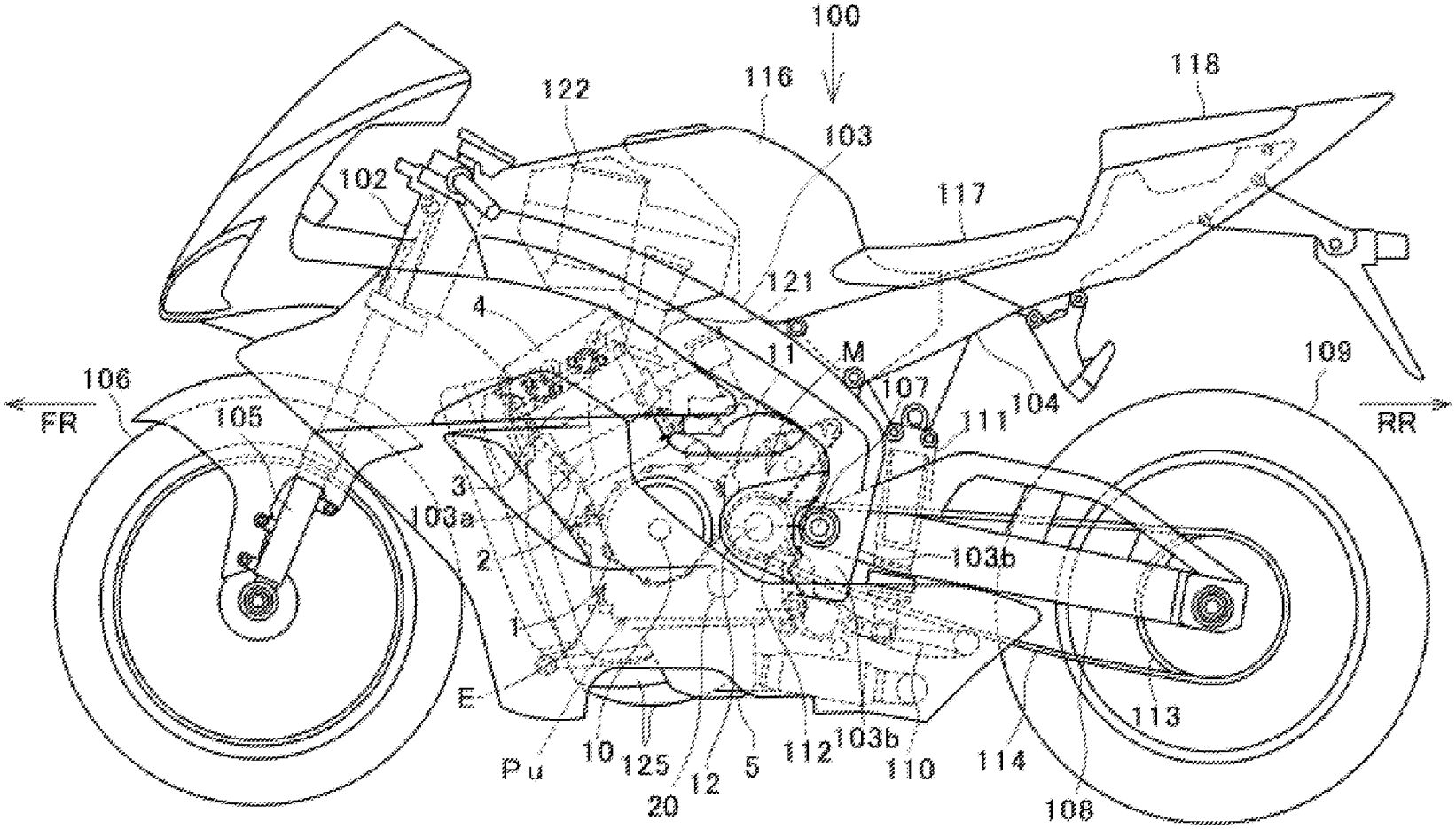
FIG. 1 is an overall side view of a motorcycle equipped with a power unit including an engine according to an embodiment of the present invention.

FIG. 1 is a side view of a motorcycle 100 which is a saddled vehicle equipped with an engine according to an embodiment of the present invention.

In the description and claims, the front, rear, right, and left directions are based on the normal standards in which the forward direction of the motorcycle 100 according to the present embodiment is the front direction. In the drawings, FR represents front, RR represents rear, RH represents right, and LH represents left.

In the vehicle body frame of the motorcycle 100, a right and left pair of main frames 103 branches rightward and leftward and obliquely downward rearward from a head pipe 102 which steerably supports a front fork 105 pivotally supporting a front wheel 106.

From the front part of the main frames 103, an engine hanger unit 103*a* suspends downward. The rear part of the main frames 103 is bent, where a pivot frame unit 103*b* extends downward.

To the rearward center of the main frames 103, a seat rail 104 is coupled and extends rearward.

A swingarm 108 having its front end pivotally supported by a pivot shaft 107 in the pivot frame unit 103*b* extends rearward. A rear wheel 109 is pivotally supported at the rear end of the swingarm 108.

Between the swingarm 108 and the pivot frame unit 103*b*, a link mechanism 110 is provided, and a rear cushion 111 is interposed between part of the link mechanism 110 and the seat rail 104.

In the vehicle body frame, between the engine hanger unit 103*a* of the main frames 103 and the pivot frame unit 103*b*, a power unit Pu is suspended. Between a driving sprocket 112 fitted to the output shaft, which is a countershaft 12, of a transmission M of the power unit Pu and a driven sprocket 113 fitted to the rear axle of the rear wheel 109, a roller chain 114 is wrapped.

In the main frames 103, an air cleaner 122 is suspended from the front half thereof and a fuel tank 116 is suspended from the rear half thereof. Behind the fuel tank 116, a main seat 117 and a pillion seat 118 are supported by the seat rail 104.

An engine E occupying the front half of the power unit Pu is a transverse inline-four water-cooled four-stroke engine, and mounted on the vehicle body frame having its cylinders properly inclined frontward.

A crankshaft 10 of the engine E is oriented in the vehicle width direction (the right-left direction) and pivotally supported by a crankcase 1. The crankcase 1 integrally includes the transmission M behind the crankshaft 10.

Figure 2:
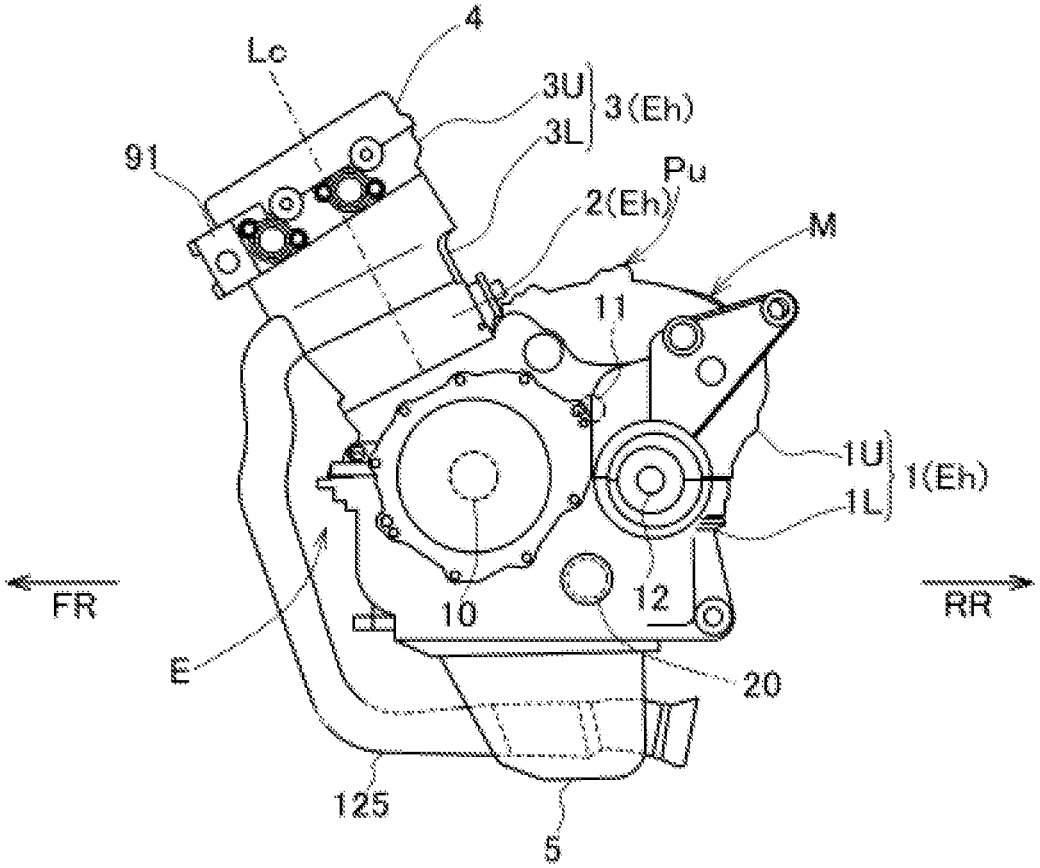
FIG. 2 is a left side view of the power unit.

With reference to FIG. 2, the engine E includes an engine body Eh formed of: the crankcase 1; a cylinder block 2 disposed on the crankcase 1 and having four cylinders separately from the crankcase 1 arranged in line; a cylinder head 3 coupled to the upper part of the cylinder block 2 via a gasket; and a cylinder head cover 4 covering the upper part of the cylinder head 3.

A cylinder axis Lc which is the central axis of the cylinders of the cylinder block 2 is inclined frontward. The cylinder block 2, the cylinder head 3, and the cylinder head cover 4 stacked on the crankcase 1 extend upward while slightly inclined frontward from the crankcase 1.

Provided below the crankcase 1 is an oil pan 5 bulging downward.

The crankcase 1 is formed of the upper and lower halves. Between the surfaces along which the crankcase 1 is halved into an upper crankcase 1U and a lower crankcase 1L, the crankshaft 10 is pivotally supported.

The crankcase 1 includes the transmission M behind the crankshaft 10. A main shaft 11 and the countershaft 12 forming the transmission M are oriented in the vehicle width direction parallel to the crankshaft 10 and pivotally supported by the crankcase 1 (see FIG. 2).

Figure 3:
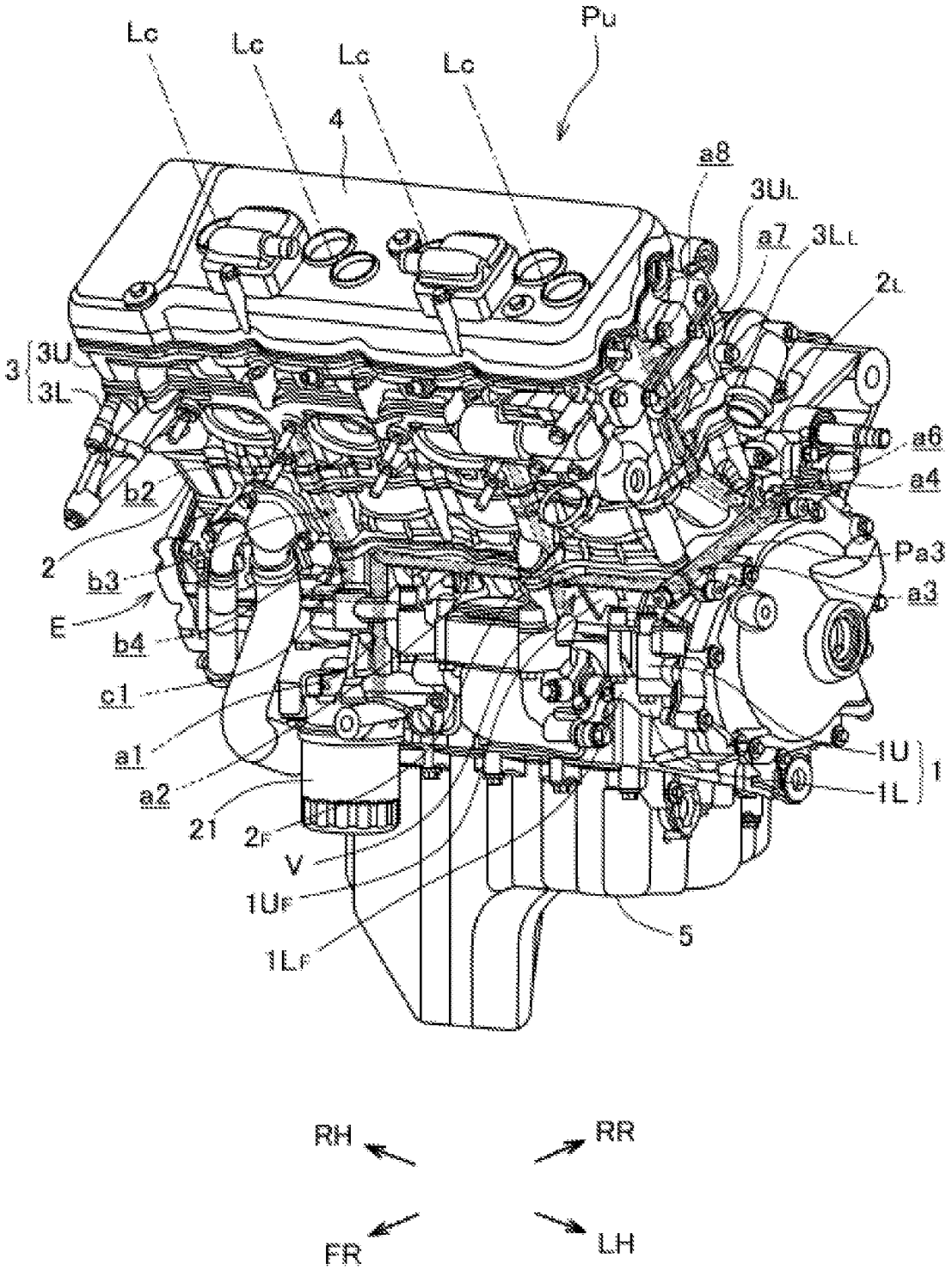
FIG. 3 is a perspective view of the power unit.

In a transmission chamber of the crankcase 1, the main shaft 11 and the countershaft 12 of the transmission M are disposed while being oriented in the right-left horizontal direction parallel to the crankshaft 10 (see FIG. 3). The countershaft 12 penetrates through the crankcase 1 leftward and projects outside, serving as the output shaft.

To the rear surface of the cylinder head 3, intake tubes respectively extend from the cylinders are connected to the air cleaner 122 via a throttle body 121 (see FIG. 1).

From the front surface of the cylinder head 3, exhaust tubes 125 respectively extend from the cylinders. The exhaust tubes 125 extend downward and bent rearward, to extend rearward on the right side of the oil pan 5.

The engine E includes a variable valve gear 40 which has the four-valve DOHC structure in the cylinder head 3.

Figure 4:
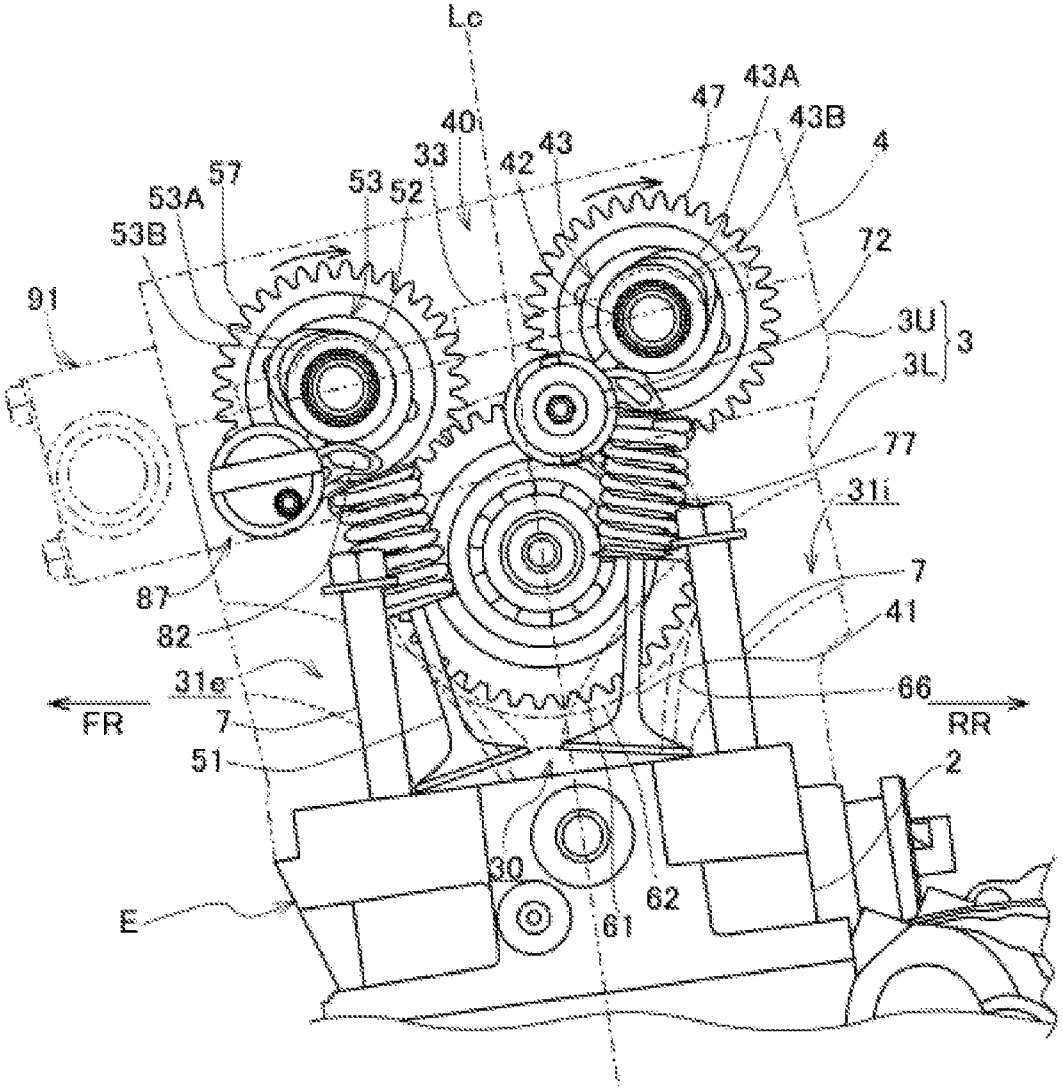
FIG. 4 is a left side view in which the contour of a cylinder head and the like of the engine is represented by a dashed-two dotted line so as to show the main part of a valve gear inside in a transparent manner

The cylinder head 3 of the engine E is divided into upper and lower halves in the cylinder axis direction (the axial direction of the cylinder axis Lc), and formed of the lower cylinder head 3L stacked on the cylinder block 2, and the upper cylinder head 3U stacked on the lower cylinder head 3L (see FIGS. 2 and 4).

With reference to FIG. 4, in the lower cylinder head 3L, for each cylinder, two intake ports 31*i* curved rearward extend obliquely upward from a combustion chamber 30, and two exhaust ports 31*e* curved frontward extend.

In the lower cylinder head 3L, intake valves 41 and exhaust valves 51 which open or close the intake openings of the intake ports 31*i* to the combustion chamber 30 and the exhaust openings of the exhaust ports 31*e* to the combustion chamber 30, respectively, are reciprocatively slidably supported in synchronization with the rotation of the crankshaft 10.

Figure 5:
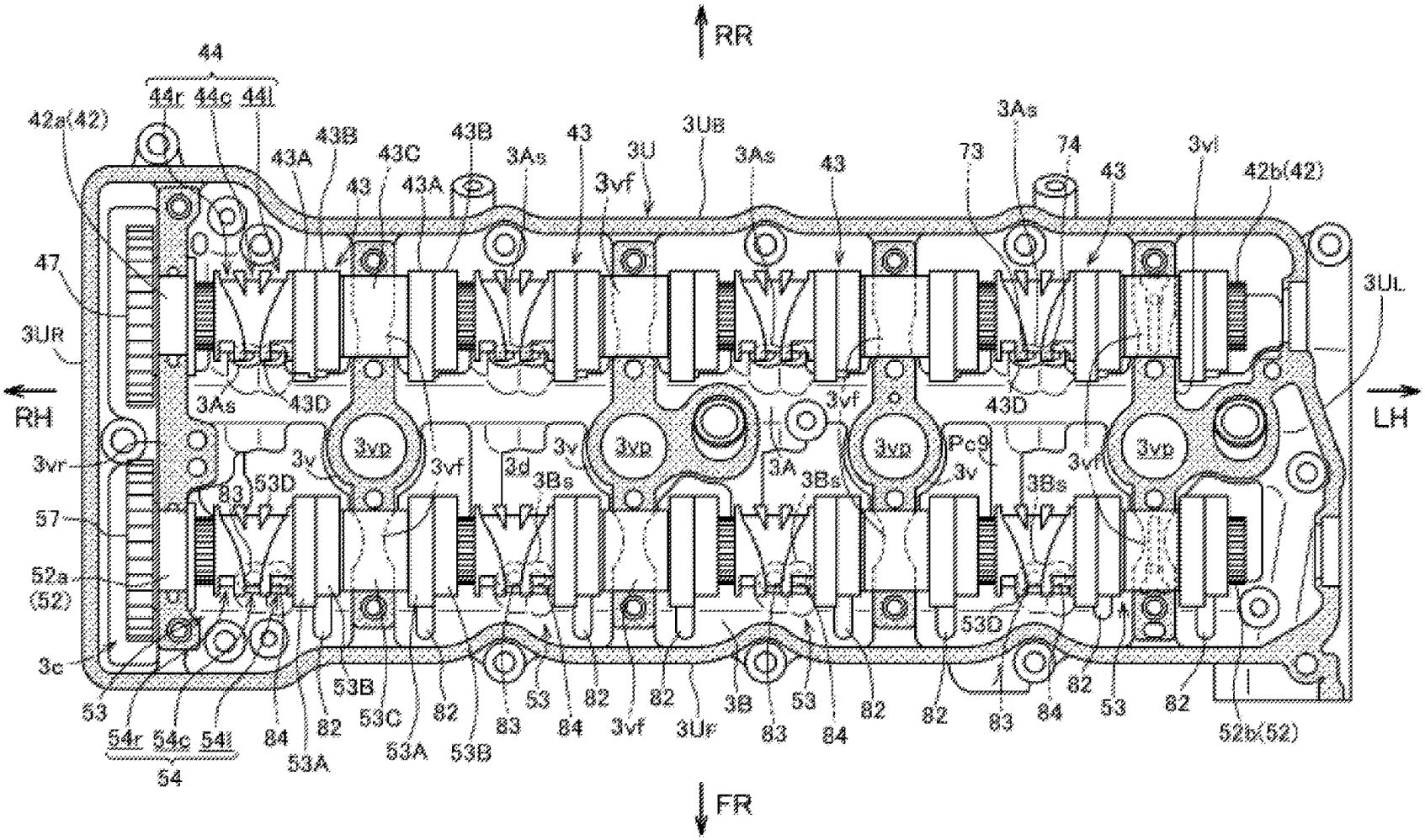
FIG. 5 is a top view of an upper cylinder head seen from above without a cylinder head cover and a camshaft holder.

The lower cylinder head 3L and the cylinder block 2 are integrally fastened to the upper crankcase 1U with stud bolts 7 (see FIGS. 4 and 5).

With reference to FIG. 5 which is a top view, the upper cylinder head 3U stacked on the lower cylinder head 3L forms a quadrangular-frame wall by four side walls, namely, a front wall $3U_F$ and a rear wall $3U_B$ positioned respectively on the front and rear sides having a great length extending in the right-left direction, and a left side wall $3U_L$ and a right side wall $3U_R$ positioned respectively on the left and right sides having a small length extending in the front-rear direction.

Inside of the quadrangular frame of the upper cylinder head 3U is partitioned, by a bearing wall 3*vr* formed parallel to the right side wall $3U_R$, into a cam chain chamber 3*c* which is smaller and positioned on the right side, and a valve chamber 3*d* positioned on the left side. The valve chamber 3*d* is further partitioned into five chambers by four bearing walls 3*v* parallel to the right and left side walls $3U_L$, $3U_R$.

Each of the bearing walls 3*v* is positioned above the center of the combustion chamber 30 of corresponding one of the cylinders, and provided with, at its center in the front-rear direction, a plug insertion pipe 3*vp* for a spark plug to be inserted.

The variable valve gear 40 is provided in the valve chamber 3*d* formed by the cylinder head 3 and the cylinder head cover 4.

With reference to FIGS. 4 and 5, four right and left pairs of intake valves 41, 41 respectively provided for the inline four cylinders are arranged in line in the right-left direction. On the four pairs of intake valves 41, 41, one intake-side camshaft 42 is disposed so as to be oriented in the right-left direction. The intake-side camshaft 42 is rotatably pivotally supported by fitting to bearing surfaces 3*vf*, which respectively form semi-arc surfaces of bearing walls 3*v*, 3*vr* of the upper cylinder head 3U, so as to be set in the camshaft holder 33.

Similarly, four right and left pair of exhaust valves 51, 51 respectively provided for the cylinders are arranged in line in the right-left direction. On the four pairs of exhaust valves 51, 51, one exhaust-side camshaft 52 is disposed so as to be oriented in the right-left direction, and rotatably pivotally supported by the bearings of the bearing walls 3*v*, 3*vr*, 3*vl* of the upper cylinder head 3U so as to be set in the camshaft holder 33.

The exhaust-side camshaft 52 is disposed on the front side of the intake-side camshaft 42 in parallel thereto.

With reference to FIG. 5, the intake-side camshaft 42 includes, around its right end, a journal part (borne part) 42*a* pivotally supported by the bearing wall 3*vr*. The intake-side camshaft 42 is axially positioned by flanges on the opposite sides relative to the borne part 42*a* via the bearing wall 3*vr*. The left part of the intake-side camshaft 42 relative to the borne part 42*a* forms a spline shaft part 42*b* provided with spline outer teeth along its outer circumferential surface, which spline shaft part 42*b* extends in an elongated manner penetrating through four bearing walls 3*v* of the valve chamber 3*d*.

To the right end flange of the intake-side camshaft 42 projecting into the cam chain chamber 3*c*, an intake-side driven gear 47 is fitted.

Similarly, the exhaust-side camshaft 52 includes, around its right end, a journal part (borne part) 52*a* pivotally supported by the bearing wall 3*vr*. The exhaust-side camshaft 52 is axially positioned by flanges on the opposite sides relative to the borne part 52*a* via the bearing wall 3*vr*. The left part of the exhaust-side camshaft 52 relative to the borne part 52*a* forms a spline shaft part 52*b* provided with spline outer teeth along its outer circumferential surface, which spline shaft part 52*b* extends in an elongated manner penetrating through four bearing walls 3*v* of the valve chamber 3*d*.

To the right end flange of the exhaust-side camshaft 52 projecting into the cam chain chamber 3*c*, an exhaust-side driven gear 57 is fitted.

Along the spline shaft part 42*b* of the intake-side camshaft 42, four intake-side cam carriers 43 which are cylindrical members are spline-fitted.

The four intake-side cam carriers 43 are axially slidably fit to the intake-side camshaft 42 while prohibited from rotating relative to the intake-side camshaft 42.

Similarly, along the spline shaft part 52*b* of the exhaust-side camshaft 52, four exhaust-side cam carriers 53 which are cylindrical members are spline-fitted. The four exhaust-side cam carriers 53 are axially slidably fit to the exhaust-side camshaft 52 while prohibited from rotating relative to the exhaust-side camshaft 52.

Figure 6:
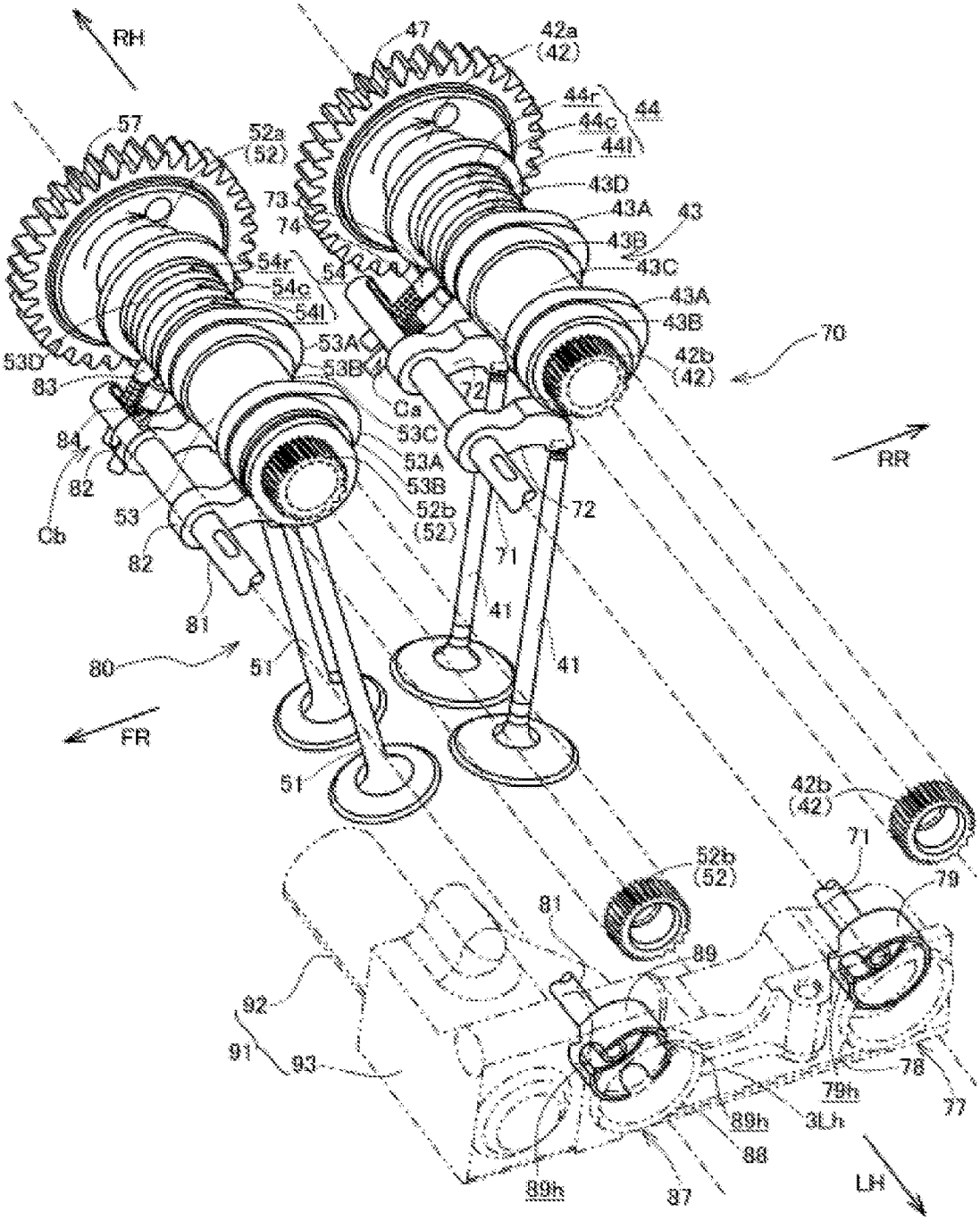
FIG. 6 is a perspective view partially omitting an intake-side cam switch mechanism and an exhaust-side cam switch mechanism so as to show just the main part.

FIG. 6 is a perspective view partially omitting an intake-side cam switch mechanism and an exhaust-side cam switch mechanism so as to show just the main part.

With reference to FIG. 6 (and FIG. 5), each of the intake-side cam carriers 43 is formed of a set of: two pairs of high-speed-side cam lobes 43A with a greater lift amount and low-speed-side cam lobes 43B with a smaller lift amount differing from each other in cam profile of the outer circumferential surface, in each pair, the high-speed-side cam lobe 43A and the low-speed-side cam lobe 43B being adjacent to each other in the axial right and left direction; and a borne cylindrical part 43C having a predetermined axial width and inserted between the two right and left pairs of high-speed-side cam lobes 43A and low-speed-side cam lobes 43B.

The adjacent high-speed-side cam lobe 43A and low-speed-side cam lobe 43B are identical to each other in the outer diameter of the base circle of the cam profile, and their base circles are at the identical circumferential position (see FIGS. 4 and 5).

Each of the intake-side cam carriers 43 includes, on the right side of the right pair of high-speed-side cam lobe 43A and low-speed-side cam lobe 43B, a lead groove cylindrical part 43D around which lead grooves 44 are circumferentially formed.

The outer diameter of the lead groove cylindrical part 43D is slightly smaller than the outer diameter of the base circle which is common to the high-speed-side cam lobe 43A and the low-speed-side cam lobe 43B.

The lead grooves 44 of the lead groove cylindrical part 43D include an annular lead groove 44*c* which circumferentially runs in a closed ring-like manner at an axial predetermined position, a right shift lead groove 44*r* and a left shift lead groove 44*l* branching rightward and leftward from the annular lead groove 44*c* spirally to positions distanced by a predetermined distance in the axially right and left directions, respectively (see FIG. 5).

Four pieces of such intake-side cam carriers 43 are successively spline-fitted to the spline shaft part 42*b* of the intake-side camshaft 42 at predetermined intervals.

As shown in FIG. 5, the intake-side camshaft 42 equipped with the four intake-side cam carriers 43 is pivotally supported by the bearing wall 3*vr* and the rear bearing surfaces 3*vf* of the four bearing walls 3*v* of the upper cylinder head 3U.

The borne part 42*a* of the intake-side camshaft 42 is supported by the bearing wall 3*vr*, and the borne cylindrical parts 43C of the intake-side cam carriers 43 are supported by the bearing walls 3*v*.

Similarly to the intake-side cam carriers 43, each of the exhaust-side cam carriers 53 spline-fitted to the spline shaft part 52*b* of the exhaust-side camshaft 52 is also formed of a set of: two pairs of high-speed-side cam lobes 53A and low-speed-side cam lobes 53B differing from each other in cam profile of the outer circumferential surface, in each pair, the high-speed-side cam lobe 53A and the low-speed-side cam lobe 53B being adjacent to each other in the axial right and left direction; and a borne cylindrical part 53C having a predetermined axial width and inserted between the two right and left pairs of high-speed-side cam lobe 53A and low-speed-side cam lobe 53B. Each of the exhaust-side cam carriers 53 includes, on the right side of the right pair of high-speed-side cam lobe 53A and low-speed-side cam lobe 53B, a lead groove cylindrical part 53D.

Lead grooves 54 formed at the lead groove cylindrical part 53D include an annular lead groove 54*c* which circumferentially runs in a closed ring-like manner, and a right shift lead groove 54*r* and a left shift lead groove 541 branching rightward and leftward from the annular lead groove 54*c* spirally to positions distanced by a predetermined distance in the axially right and left directions, respectively (see FIG. 5).

As shown in FIG. 5, the exhaust-side camshaft 52 equipped with four pieces of such exhaust-side cam carriers 53 successively spline-fitted to the spline shaft part 52*b* is pivotally supported by the bearing wall 3*vr* and the front bearing surfaces 3*vf* of the four bearing walls 3*v* of the upper cylinder head 3U.

The borne part 52*a* of the exhaust-side camshaft 52 is supported by the bearing wall 3*vr*, and the borne cylindrical parts 53C of the exhaust-side cam carriers 53 are supported by the bearing walls 3*v*.

In the foregoing manner, when the intake-side camshaft 42 (and the intake-side cam carriers 43) and the exhaust-side camshaft 52 (and the exhaust-side cam carriers 53) are supported by the bearing wall 3*vr* and the four bearing walls 3*v* of the upper cylinder head 3U, by the camshaft holder 33 (see FIG. 4) being stacked on the bearing wall 3*vr* and the four bearing walls 3*v*, the intake-side camshaft 42 (and the intake-side cam carriers 43) and the exhaust-side camshaft 52 (and the exhaust-side cam carriers 53) are set in and rotatably pivotally supported.

That is, the four intake-side cam carriers 43 are axially slidably and rotatably pivotally supported while rotating with the intake-side camshaft 42. The four exhaust-side cam carriers 53 are also axially slidably and rotatably pivotally supported while rotating with the exhaust-side camshaft 52.

The intake-side driven gear 47 mounted on the right end of the intake-side camshaft 42 and the exhaust-side driven gear 57 mounted on the right end of the exhaust-side camshaft 52 are identical to each other in diameter, and juxtaposed to each other on the rear side and the front side in the cam chain chamber 3*c*. As shown in FIG. 4, a large-diameter idle gear 61 meshing both the intake-side driven gear 47 and the exhaust-side driven gear 57 is rotatably pivotally supported beneath the position between the intake-side driven gear 47 and the exhaust-side driven gear 57.

With reference to FIGS. 4 and 5, the idle gear 61 is provided with a coaxial idle chain sprocket 62 so as to be integrally rotatable. A cam chain 66 is wrapped around the idle chain sprocket 62. The cam chain 66 is wrapped around also a small-diameter drive chain sprocket (not shown) fitted to the crankshaft 10 positioned below.

Accordingly, the rotation of the crankshaft 10 is transferred to the idle chain sprocket 62 via the cam chain 66, whereby the rotation of the idle gear 61 which rotates integrally with the idle chain sprocket 62 rotates the intake-side driven gear 47 and the exhaust-side driven gear 57 meshing with the idle gear 61. Therefore, the intake-side driven gear 47 integrally rotates the intake-side camshaft 42, and the exhaust-side driven gear 57 integrally rotates the exhaust-side camshaft 52.

With reference to FIG. 6, an intake-side switch drive shaft 71 of an intake-side cam switch mechanism 70 is disposed frontward obliquely below and parallel to the intake-side camshaft 42. An exhaust-side switch drive shaft 81 of an exhaust-side cam switch mechanism 80 is disposed frontward obliquely below and parallel to the exhaust-side camshaft 52.

The intake-side switch drive shaft 71 and the exhaust-side switch drive shaft 81 are supported by the upper cylinder head 3U.

Figure 12:
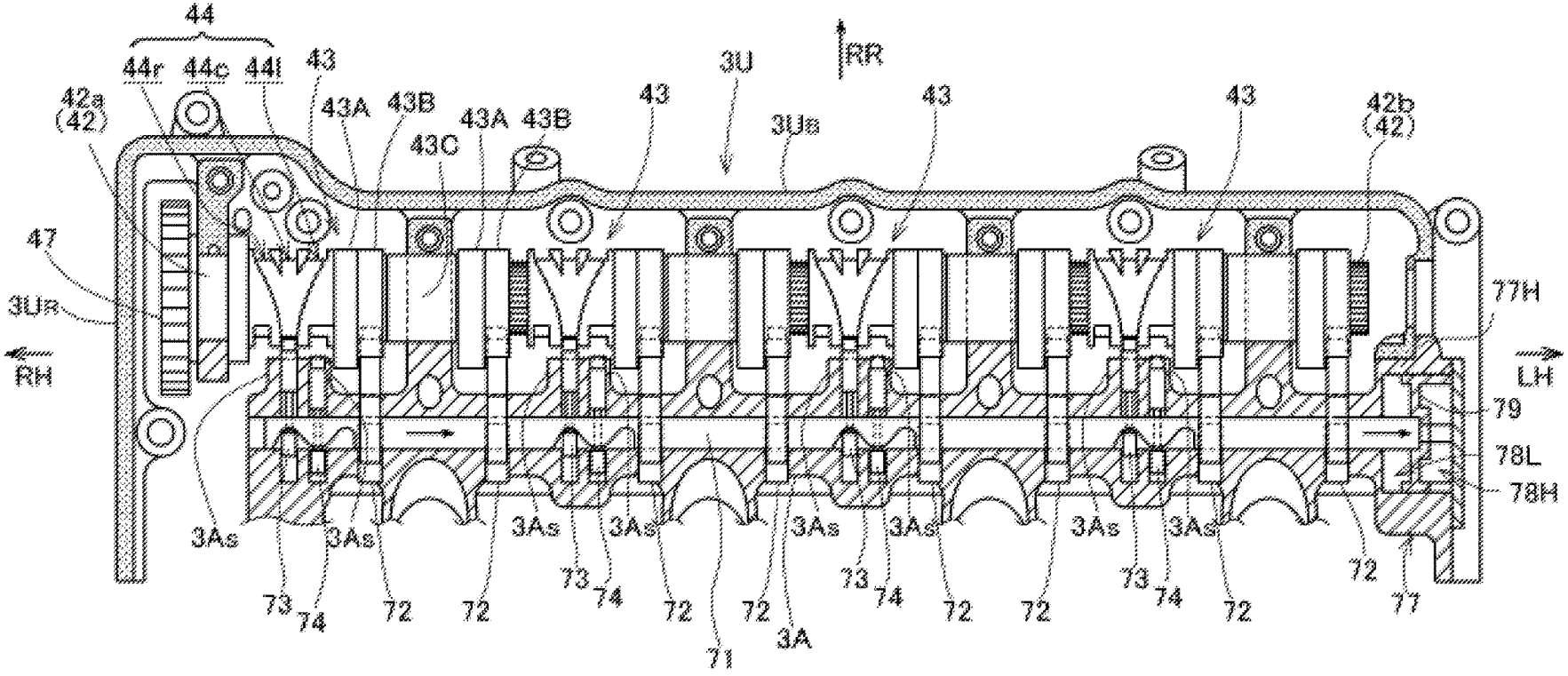
FIG. 12 is an explanatory view showing the operation state of main members of the intake-side cam switch mechanism in a low-speed drive mode of the engine.

With reference to FIGS. 5, 6, and 12, in the upper cylinder head 3U, a tubular part 3A oriented in the right-left direction in the valve chamber 3*d* is formed straight at a position slightly rearward than the center to penetrate from the bearing wall 3*vr* through the four bearing walls 3*v*.

Similarly, in the upper cylinder head 3U, a tubular part 3B oriented in the right-left direction in the valve chamber 3*d* is formed straight at the inner surface of the front wall $3U_F$ to penetrate from the bearing wall 3*vr* through the four bearing walls 3*v* (see FIG. 5).

The intake-side switch drive shaft 71 is axially slidably fitted into the axial hole of the tubular part 3A, and the exhaust-side switch drive shaft 81 is axially slidably fitted into the axial hole of the tubular part 3B.

Two opposite portions with reference to the bearing wall 3*v* in the tubular part 3A corresponding to the right and left intake valves 41, 41 are absent, to expose the intake-side switch drive shaft 71. By the portions exposing the intake-side switch drive shaft 71, intake rocker arms 72, 72 are swingably pivotally supported (see FIGS. 5 and 12).

That is, the intake-side switch drive shaft 71 also functions as the rocker arm shaft.

With reference to FIGS. 4 and 6, the tip of each intake rocker arm 72 abuts on the upper end of the intake valve 41. Onto the curved upper end surface of the intake rocker arm 72, the high-speed-side cam lobe 43A or the low-speed-side cam lobe 43B slidably abuts by the intake-side cam carrier 43 shifting in the axial direction.

Accordingly, as the intake-side cam carrier 43 rotates, the high-speed-side cam lobe 43A or the low-speed-side cam lobe 43B swings the intake rocker arm 72 according to its profile, to press the intake valve 41 to open the intake valve port at the combustion chamber 30.

Similarly, two opposite portions with reference to the bearing wall 3V in the tubular part 3B corresponding to the right and left exhaust valves 51, 51 are absent, to expose the exhaust-side switch drive shaft 81. By the portions exposing the exhaust-side switch drive shaft 81, exhaust rocker arms 82 are swingably pivotally supported (see FIGS. 5 and 6).

That is, the exhaust-side switch drive shaft 81 also functions as the rocker arm shaft.

With reference to FIGS. 4 and 6, the tip of each exhaust rocker arm 82 abuts on the upper end of the exhaust valve 51. Onto the curved upper end surface of the exhaust rocker arm 82, the high-speed-side cam lobe 53A or the low-speed-side cam lobe 53B slidably abuts by the exhaust-side cam carrier 53 shifting.

Accordingly, as the exhaust-side cam carrier 53 rotates, the high-speed-side cam lobe 53A or the low-speed-side cam lobe 53B swings the exhaust rocker arm 82 according to its profile, to press the exhaust valve 51 to open the discharge valve port at the combustion chamber 30.

With reference to FIG. 12, at the portions corresponding to the lead groove cylindrical part 43D of each intake-side cam carrier 43, two adjacent right and left cylindrical boss parts 3As, 3As are formed in the tubular part 3A, so as to project toward the lead groove cylindrical part 43D.

The hole inside the cylindrical boss part 3As penetrates through the tubular part 3A.

Into the holes inside the cylindrical boss parts 3As, 3As, a first switch pin 73 and a second switch pin 74 are respectively slidably inserted.

Figure 7:
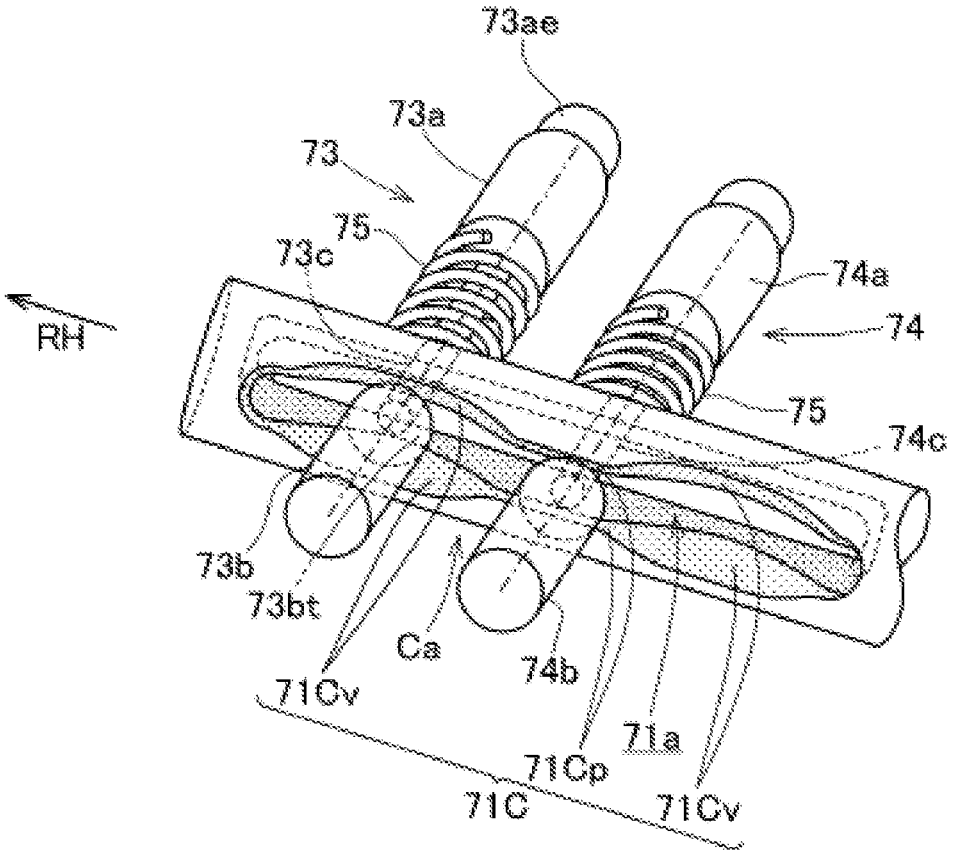
FIG. 7 is a perspective view of an intake-side switch drive shaft to which a first switch pin and a second switch pin are mounted.

With reference to FIG. 7, the first switch pin 73 is formed of a leading-end columnar part 73*a*, a basal-end columnar part 73*b*, and an intermediate coupling bar part 73*c* straightly coupling the leading-end columnar part 73*a* and the basal-end columnar part 73*b*.

The basal-end columnar part 73*b* is smaller in outer diameter than the leading-end columnar part 73*a*.

From the leading-end columnar part 73*a,* a smaller-diameter engaging end 73*ae* further projects.

The end surface of the basal-end columnar part 73*b* on the intermediate coupling bar part 73*c* side forms a truncated cone end surface 73*bt* of a cone.

The second switch pin 74 is similar in shape, and includes a leading-end columnar part 74*a,* a basal-end columnar part 74*b,* and an intermediate coupling bar part 74*c* straightly coupling the leading-end columnar part 74*a* and the basal-end columnar part 74*b.*

As shown in FIG. 7, the intake-side switch drive shaft 71 is provided with a long hole 71*a* penetrating through the axial center. The width of the long hole 71*a* is slightly greater than the diameter of the intermediate coupling bar part 73*c* of the first switch pin 73, and smaller than the diameter of the basal-end columnar part 73*b.*

One opening end surface of the long hole 71*a* of the intake-side switch drive shaft 71 is provided with a cam surface 71C in which two recessed curved surfaces 71Cv being recessed in a predetermined shape on the right and left sides and continuous to each other via a flat surface 71Cp are formed.

The first switch pin 73 is mounted in the state where the intermediate coupling bar part 73*c* penetrates through the long hole 71*a* of the intake-side switch drive shaft 71, and the truncated cone end surface 73*bt* of the basal-end columnar part 73*b* biased by the coil spring 75 is pressed against and engages with the cam surface 71C, which is the opening end surface of the long hole 71*a* of the intake-side switch drive shaft 71. This structures a direct-acting cam mechanism Ca, in which: the intake-side switch drive shaft 71 axially shifting shifts the cam surface 71C on which the truncated cone end surface 73*bt* of the basal-end columnar part 73*b* of the first switch pin 73 abuts, which truncated cone end surface 73*bt* is at an axially fixed position and configured to shift in the direction perpendicular to the axial direction; whereby the first switch pin 73 advances or retracts perpendicularly to the axial direction guided by the shape of the cam surface 71C.

As shown in FIG. 7, the first switch pin 73 and the second switch pin 74 are disposed parallel to each other penetrating through the common long hole 71*a* of the intake-side switch drive shaft 71.

FIG. 7 shows the state where, in the cam surface 71C of the intake-side switch drive shaft 71, the center of the recessed curved surface 71Cv is at the position of the first switch pin 73. The first switch pin 73 is at the advanced position having its truncated cone end surface 73*bt* abutted on the recessed curved surface 71Cv. The second switch pin 74 is at the retracted position abutting on the flat surface 71Cp in the cam surface 71C.

When the intake-side switch drive shaft 71 shifts rightward from this state, the truncated cone end surface 73*bt* of the first switch pin 73 ascends the slope of the recessed curved surface 71Cv from the center of the recessed curved surface 71Cv thereby retracting, to abut on the flat surface 71Cp. The truncated cone end surface 74*bt* of the second switch pin 74 descends the slope of the recessed curved surface 71Cv from the flat surface 71Cp thereby advancing, to abut on the center of the recessed curved surface 71Cv.

In this manner, the axial shift of the intake-side switch drive shaft 71 causes the first switch pin 73 and the second switch pin 74 to alternately advance and retract.

While not shown in the drawings, in the tubular part 3B into which the exhaust-side switch drive shaft 81 is axially slidably inserted, similarly to the tubular part 3A, two cylindrical boss parts 3Bs, 3Bs into which the first switch pin 83 and the second switch pin 84 are respectively slidably inserted are formed adjacent to each other on the right and left sides. The first switch pin 83 and the second switch pin 84 are disposed parallel to each other penetrating through a common long hole 81*a* of the exhaust-side switch drive shaft 81 (see FIGS. 5 and 6).

Figure 8:
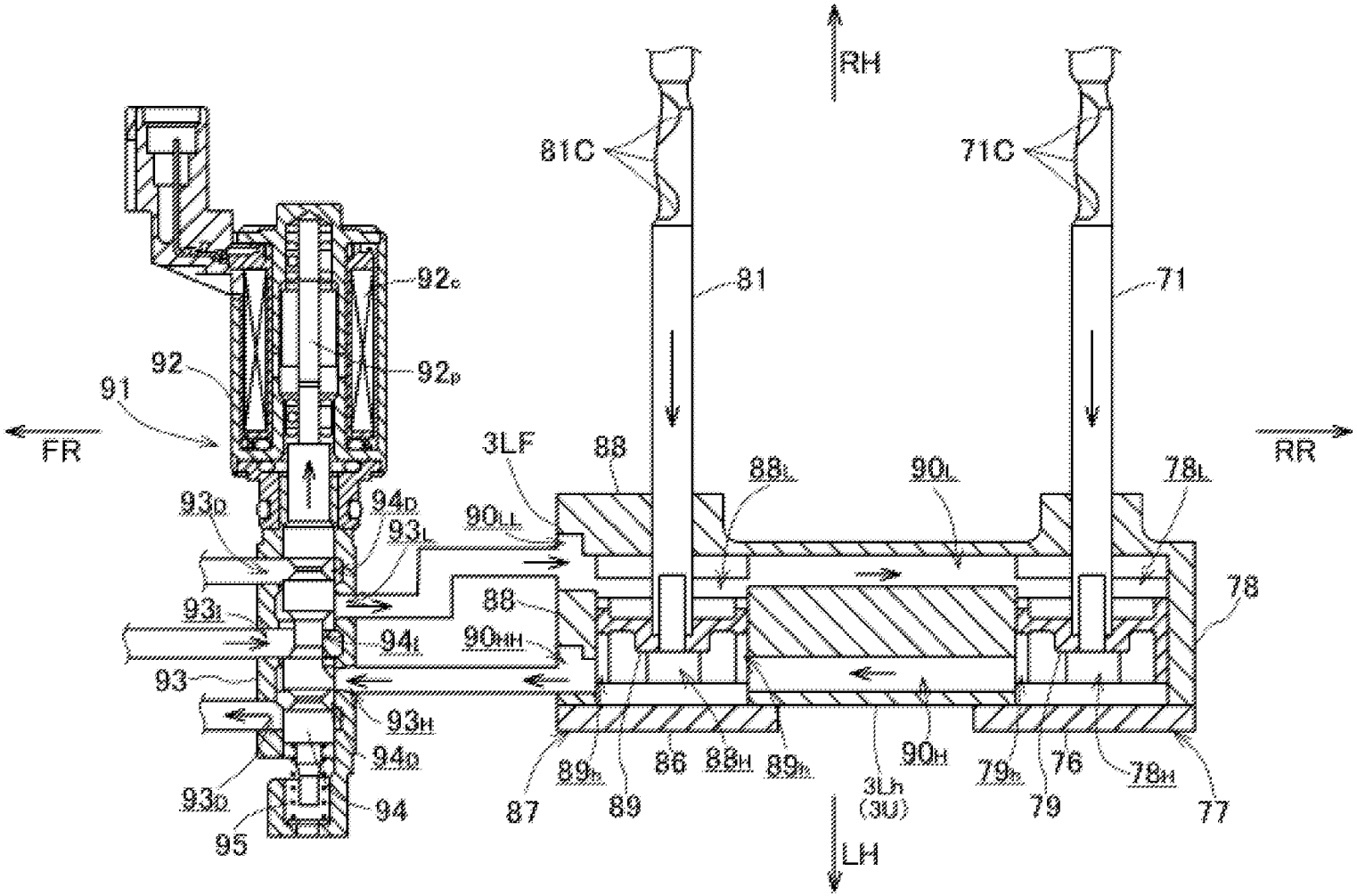
FIG. 8 is an explanatory view showing the hydraulic oil supply and discharge state of an intake-side hydraulic actuator and an exhaust-side hydraulic actuator when a linear solenoid valve is not energized.

A direct-acting cam mechanism Cb is structured in which: the exhaust-side switch drive shaft 81 axially shifting shifts the cam surface 81C (a cam surface which is identical in shape to the cam surface 71C, see FIG. 8) of the long hole 81*a;* whereby the first switch pin 83 and the second switch pin 84 alternately advance and retract perpendicularly to the axial direction.

As shown in FIG. 5, the exhaust-side switch drive shaft 81 and the first and second switch pins 83, 84 in the cylindrical boss parts 3Bs, 3Bs are disposed so as to at least partially overlap with the extension of the axial direction of the front (exhaust-side) right four stud bolts 7 out of the stud bolts 7 which integrally fasten the crankcase 1 and the cylinder block 2 and the cylinder head 3 stacked on the crankcase 1.

With reference to FIGS. 5 and 6, at the left side wall 3$U_L$ of the upper cylinder head 3U, an intake-side hydraulic actuator 77 axially shifting the intake-side switch drive shaft 71 is provided so as to project into the valve chamber 3*d.* In the valve chamber 3*d,* an exhaust-side hydraulic actuator 87 which axially shifts the exhaust-side switch drive shaft 81 is provided so as to project while being juxtaposed to the intake-side hydraulic actuator 77 on the front side thereof.

That is, the intake-side hydraulic actuator 77 and the exhaust-side hydraulic actuator 87 are integrated with the upper cylinder head 3U.

As shown in FIG. 5, the intake-side hydraulic actuator 77 and the exhaust-side hydraulic actuator 87 are disposed so as to at least partially overlap with the extension of the axial direction of the leftmost two stud bolts 7, 7 out of the ten stud bolts 7 which integrally fasten the crankcase 1 and the cylinder block 2 and the cylinder head 3 stacked on the crankcase 1.

Figure 9:
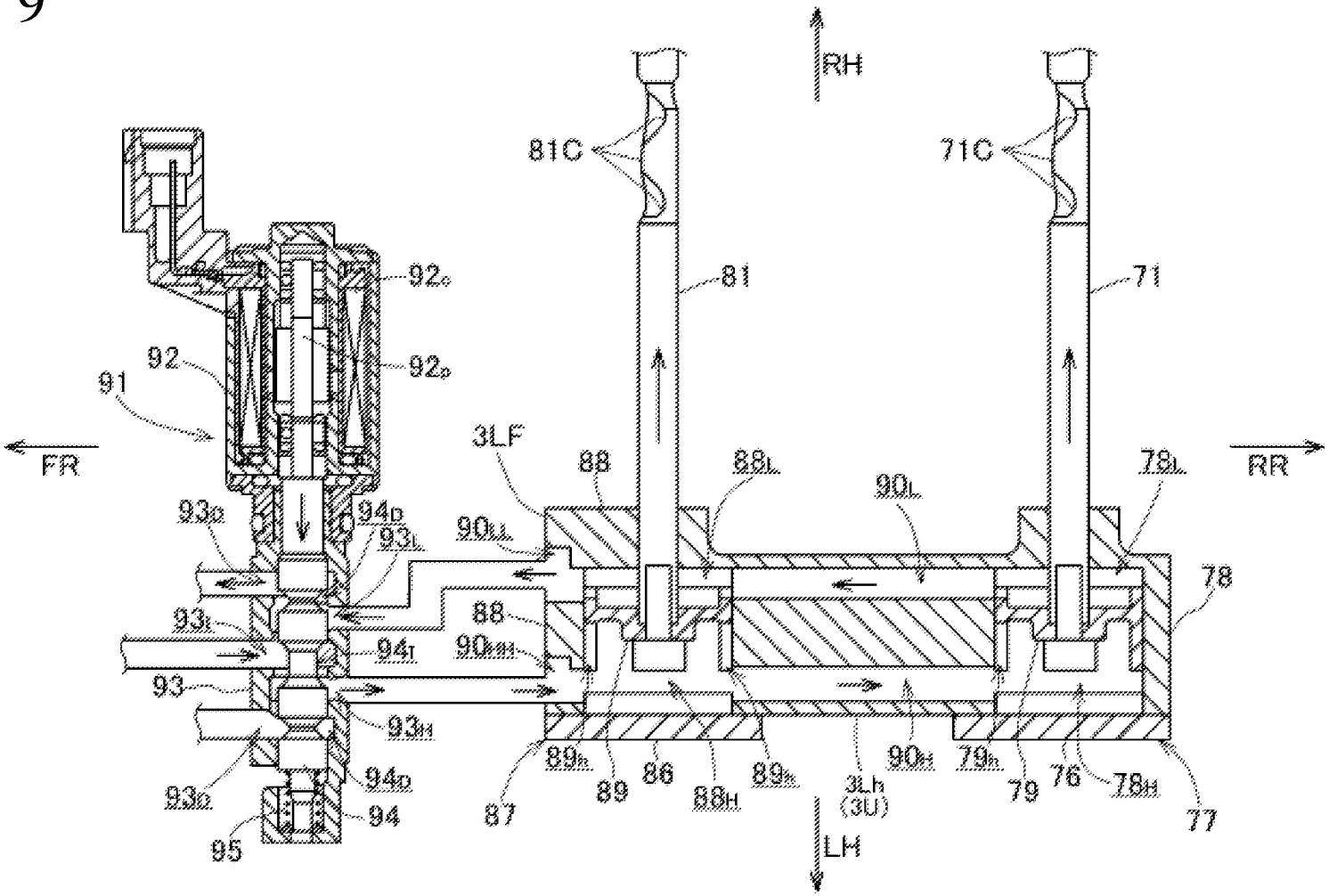
FIG. 9 is an explanatory view showing the hydraulic oil supply and discharge state of the intake-side hydraulic actuator and the exhaust-side hydraulic actuator when the linear solenoid valve is energized.

With reference to FIGS. 8 and 9, the intake-side hydraulic actuator 77 has a bottomed cylindrical intake-side actuator driver 79 fit to a circular bore-like in-housing chamber of the intake-side actuator housing 78 reciprocatively slidably in the axial direction of the intake-side switch drive shaft 71 (the right-left direction). The left end of the intake-side switch drive shaft 71 is fitted to the intake-side actuator driver 79 so that the intake-side switch drive shaft 71 and the intake-side actuator driver 79 integrally shift.

The in-housing chamber of the intake-side actuator housing 78 has its left opening closed by a lid member 76. The intake-side actuator driver 79 divides the in-housing chamber into a left high-speed-side hydraulic chamber 78$_H$ and a right low-speed-side hydraulic chamber 78$_L$.

Similarly, the exhaust-side hydraulic actuator 87 has a bottomed cylindrical exhaust-side actuator driver 89 fit to a circular bore-like in-housing chamber of the exhaust-side actuator housing 88 reciprocatively in the right-left direction. The left end of the exhaust-side switch drive shaft 81 is fitted to the exhaust-side actuator driver 89 so that the exhaust-side switch drive shaft 81 and the exhaust-side actuator driver 89 integrally shift.

The in-housing chamber of the exhaust-side actuator housing 88 has its left opening closed by a lid member 86. The exhaust-side actuator driver 89 divides the in-housing chamber into a left high-speed-side hydraulic chamber 88$_H$ and a right low-speed-side hydraulic chamber 88$_L$.

With reference to FIGS. 8 and 9, formed at the left side wall 3$U_L$ of the upper cylinder head 3U are: a high-speed-side supply and discharge oil passage $90_H$ which communicates with the high-speed-side hydraulic chamber $78_H$ of the intake-side hydraulic actuator 77 and the high-speed-side hydraulic chamber $88_H$ of the exhaust-side hydraulic actuator 87; and a low-speed-side supply and discharge oil passage $90_L$ which communicates with the low-speed-side hydraulic chamber $78_L$ of the intake-side hydraulic actuator 77 and the low-speed-side hydraulic chamber $88_L$ of the exhaust-side hydraulic actuator 87.

Figure 10:
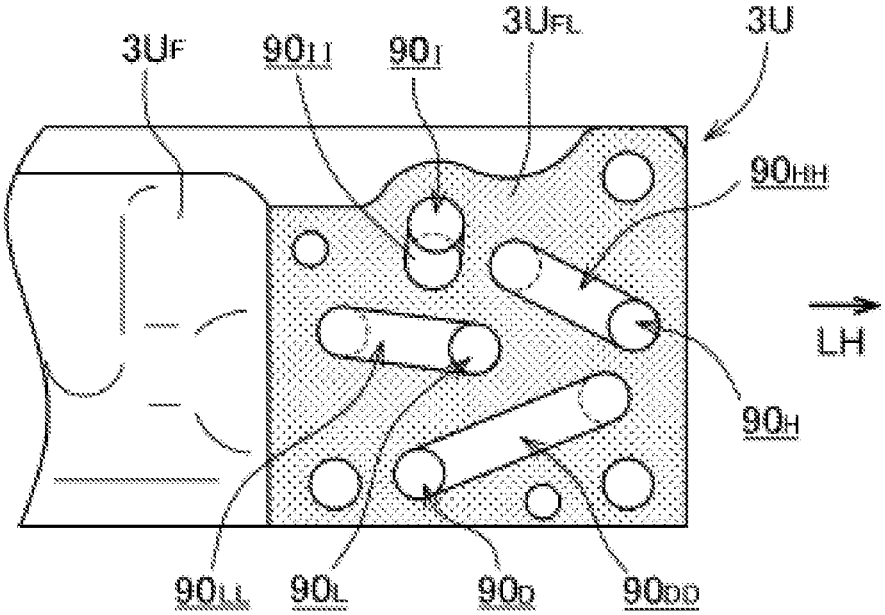
FIG. 10 is a front view showing a left-end matching surface of the front side surface of the front wall of the upper cylinder head.

The high-speed-side supply and discharge oil passage $90_H$ penetrates frontward the high-speed-side hydraulic chamber $88_H$ of the exhaust-side hydraulic actuator 87 and opens at a left-end matching surface $3U_{FL}$ at the left end of the front surface of the front wall $3U_F$ of the upper cylinder head 3U (FIG. 10). The low-speed-side supply and discharge oil passage $90_L$ penetrates frontward the low-speed-side hydraulic chamber $88_L$ of the exhaust-side hydraulic actuator 87 and opens at a left-end matching surface $3U_{FL}$ at the front wall $3U_F$ (FIG. 10).

A cylindrical part of the bottomed cylindrical intake-side actuator driver 79 of the intake-side hydraulic actuator 77 opposing to the high-speed-side supply and discharge oil passage $90_H$ is provided with a long hole 79*h* elongated in the axial direction. Therefore, the communication port which opens at the in-housing chamber of the high-speed-side supply and discharge oil passage $90_H$ bored in the intake-side actuator housing 78 constantly opposes to the long hole 79*h* of the cylindrical part despite shifting of the intake-side actuator driver 79, thereby constantly maintaining the communication between the high-speed-side supply and discharge oil passage $90_H$ and the high-speed-side hydraulic chamber $78_H$.

On the front and rear sides of the cylindrical part of the bottomed cylindrical exhaust-side actuator driver 89 of the exhaust-side hydraulic actuator 87 opposing to the high-speed-side supply and discharge oil passage $90_H$, long holes 89*h*, 89*h* elongated in the axial direction are formed. Therefore, the communication port which opens at the in-housing chamber of the high-speed-side supply and discharge oil passage $90_H$ bored in the exhaust-side actuator housing 88 constantly opposes to the long holes 89*h*, 89*h* of the cylindrical part despite shifting of the exhaust-side actuator driver 89, thereby constantly maintaining the communication between the high-speed-side supply and discharge oil passage $90_H$ and the high-speed-side hydraulic chamber $88_H$.

Note that, the low-speed-side supply and discharge oil passage $90_L$ constantly communicates with the low-speed-side hydraulic chamber $78_L$ of the intake-side hydraulic actuator 77 and the low-speed-side hydraulic chamber $88_L$ of the exhaust-side hydraulic actuator 87 irrespective of whether the intake-side actuator driver 79 of the intake-side hydraulic actuator 77 and the exhaust-side actuator driver 89 of the exhaust-side hydraulic actuator 87 shift rightward or leftward.

FIG. 10 shows the left-end matching surface $3U_{FL}$ at the front surface of the front wall $3U_F$ of the upper cylinder head 3U. At the left-end matching surface $3U_{FL}$, the high-speed-side supply and discharge oil passage $90_H$ and the low-speed-side supply and discharge oil passage $90_L$ open. Long grooves $90_{HH}$, $90_{LL}$ are formed rightward and slightly obliquely upward from the openings.

On the left-end matching surface $3U_{FL}$ at the front surface of the front wall $3U_F$ of the upper cylinder head 3U, a linear solenoid valve 91 is mounted.

With reference to FIGS. 8 and 9, in the linear solenoid valve 91, a sleeve 93 is provided on the extension of an electromagnetic solenoid 92 including an electromagnetic coil 92*c* and a plunger 92*p* shifting in the electromagnetic coil 92*c*.

A spool valve 94 is slidably inserted into the sleeve 93. By being biased by a spring 95, the spool valve 94 coaxially abuts on the plunger 92*p*.

The linear solenoid valve 91 is mounted on the left-end matching surface $3U_{FL}$ which is the left end of the front surface of the upper cylinder head 3U, having the spool valve 94, which is coaxial to the plunger 92*p* of the electromagnetic solenoid 92, oriented in the right-left horizontal direction (see FIGS. 2 and 3).

As shown in FIGS. 8 and 9, the linear solenoid valve 91 shifts in the right-left direction having the spool valve 94 set parallel to the intake-side switch drive shaft 71 and the exhaust-side switch drive shaft 81 and oriented in the right-left direction.

Accordingly, when the electromagnetic coil 92*c* is energized, the plunger 92*p* projects leftward (LH) with the spool valve 94 in the sleeve 93, against the biasing force of the spring 95 (see FIG. 9). When the energization of the electromagnetic coil 92*c* is cancelled, the spool valve 94 retracts rightward (RH) by the biasing force of the spring 95 (see FIG. 8).

The sleeve 93 is provided with a hydraulic pressure supply port $93_I$ positioned at the center, a high-speed-side supply and discharge port $93_H$ and a low-speed-side supply and discharge port $93_L$ positioned on the opposite sides of the hydraulic pressure supply port $93_I$, and a pair of drain ports $93_D$, $93_D$ positioned on the opposite sides of the supply and discharge ports $93_H$, $93_L$.

The spool valve 94 sliding inside the sleeve 93 is provided with a hydraulic pressure supply groove $94_I$ provided at the center, and a pair of drain grooves $94_D$, $94_D$ axially aligned and positioned on the opposite sides of the hydraulic pressure supply groove $94_I$ via lands.

Note that, FIGS. 8 and 9 schematically show the sleeve 93 of the linear solenoid valve 91.

Figure 11:
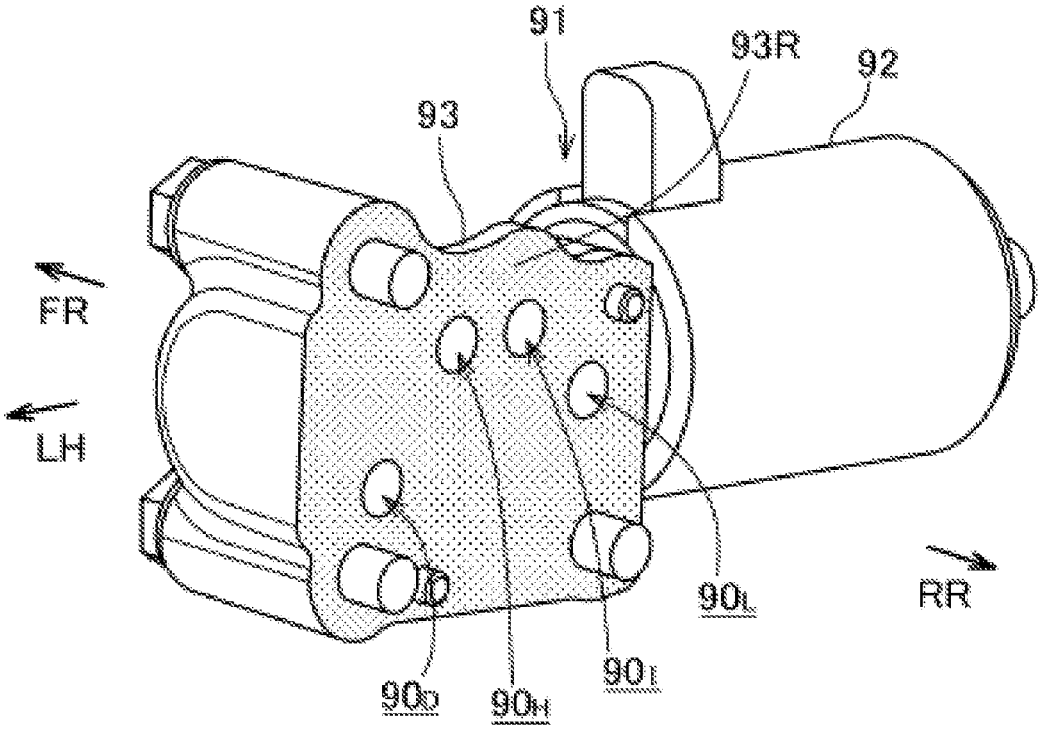
FIG. 11 is a perspective view of the linear solenoid valve.

FIG. 11 shows the actual linear solenoid valve 91. The rear side surface of the sleeve 93 is a matching surface 93R. At the matching surface 93R, the hydraulic pressure supply port $93_I$, the high-speed-side supply and discharge port $93_H$, the low-speed-side supply and discharge port $93_L$, and the drain port $93_D$ open.

This matching surface 93R which is the rear side surface of the sleeve 93 of the linear solenoid valve 91 is matched with the left-end matching surface $3U_{FL}$ of the front surface of the front wall $3U_F$ of the upper cylinder head 3U shown in FIG. 10, whereby the linear solenoid valve 91 is mounted on the upper cylinder head 3U.

Accordingly, at the left-end matching surface $3U_{FL}$ of the front wall $3U_F$ of the upper cylinder head 3U shown in FIG. 10, respectively corresponding to the hydraulic pressure supply port $93_I$, the high-speed-side supply and discharge port $93_H$, the low-speed-side supply and discharge port $93_L$, and the drain port $93_D$ of the sleeve 93, a long groove $90_H$ of a hydraulic pressure supply passage $90_I$, the long groove $90_{HH}$ of the high-speed-side supply and discharge oil passage $90_H$, the long groove $90_{LL}$ of the low-speed-side supply and discharge oil passage $90_L$, and a long groove $90_{DD}$ of a drain oil passage $90_D$ open.

In the state shown in FIG. 8, the electromagnetic solenoid 92 of the linear solenoid valve 91 is not energized and the spool valve 94 retracts rightward (RH) by the biasing force of the spring 95. Therefore, hydraulic oil having flowed into the hydraulic pressure supply port $93_I$ of the sleeve 93 from the hydraulic pressure supply passage $90_I$ via the long groove $90_H$ flows from the low-speed-side supply and discharge port $93_L$ via the hydraulic pressure supply groove $94_I$ into the low-speed-side supply and discharge oil passage $90_L$ of the long groove $90_{LL}$ at the left side wall $3U_L$ of the upper cylinder head 3U, and supplied to the low-speed-side hydraulic chamber $88_L$ of the exhaust-side hydraulic actuator 87 and therefrom to the low-speed-side hydraulic chamber $78_L$ of the intake-side hydraulic actuator 77. Thus, the intake-side actuator driver 79 of the intake-side hydraulic actuator 77 and the exhaust-side actuator driver 89 of the exhaust-side hydraulic actuator 87 are pushed and shift leftward (LH).

Since the actuator drivers 79, 89 of the intake-side hydraulic actuator 77 and the exhaust-side hydraulic actuator 87 shift leftward, hydraulic oil flows from the high-speed-side hydraulic chambers $78_H$, $88_H$ of the intake-side hydraulic actuator 77 and the exhaust-side hydraulic actuator 87 to the high-speed-side supply and discharge oil passage $90_H$. The hydraulic oil further flows from the high-speed-side supply and discharge oil passage $90_H$, via the long groove $90_{HH}$, to the high-speed-side supply and discharge port $93_H$ of the sleeve 93 of the linear solenoid valve 91, and discharged from the drain port $93_D$ via the drain groove $94_D$ to the drain oil passage $90_D$ via the long groove $90_{DD}$.

In this manner, when the electromagnetic solenoid 92 of the linear solenoid valve 91 is not energized, as shown in FIG. 8, hydraulic oil is supplied to the low-speed-side hydraulic chambers $78_L$, $88_L$ of the intake-side hydraulic actuator 77 and the exhaust-side hydraulic actuator 87, and the hydraulic oil flows out from the high-speed-side hydraulic chambers $78_H$, $88_H$, whereby the actuator drivers 79, 89 of the intake-side hydraulic actuator 77 and the exhaust-side hydraulic actuator 87 simultaneously shift leftward (LH). Therefore, the intake-side switch drive shaft 71 and the exhaust-side switch drive shaft 81 respectively integrally fitted to the actuator drivers 79, 89 also simultaneously shift leftward (LH).

When the electromagnetic solenoid 92 of the linear solenoid valve 91 is energized, as shown in FIG. 9, the spool valve 94 projects leftward (LH) against the biasing force of the spring 95, and hydraulic oil having flowed into the hydraulic pressure supply port $93_I$ of the sleeve 93 flows from the high-speed-side supply and discharge port $93_H$ via the hydraulic pressure supply groove $94_I$ into the high-speed-side supply and discharge oil passage $90_H$ at the left side wall $3U_L$ of the upper cylinder head 3U via the long groove $90_{HH}$, and supplied to the high-speed-side hydraulic chamber $88_H$ of the exhaust-side hydraulic actuator 87 and therefrom to the high-speed-side hydraulic chamber $78_H$ of the intake-side hydraulic actuator 77. Thus, the intake-side actuator driver 79 of the intake-side hydraulic actuator 77 and the exhaust-side actuator driver 89 of the exhaust-side hydraulic actuator 87 are pushed rightward (RH) and shift.

Note that, from the low-speed-side hydraulic chambers $78_L$, $88_L$ of the intake-side hydraulic actuator 77 and the exhaust-side hydraulic actuator 87, hydraulic oil flows out to the low-speed-side supply and discharge oil passage $90_L$. The hydraulic oil further flows out from the low-speed-side supply and discharge oil passage $90_L$ via the long groove $90_{LL}$ to the low-speed-side supply and discharge port $93_L$ of the electromagnetic solenoid 92 of the linear solenoid valve 91, and discharged from the drain port $93_D$ via the drain groove $94_D$ to the drain oil passage $90_D$.

In this manner, when the electromagnetic solenoid 92 of the linear solenoid valve 91 is energized, as shown in FIG. 9, hydraulic oil is supplied to the high-speed-side hydraulic chambers $78_H$, $88_H$ of the intake-side hydraulic actuator 77 and the exhaust-side hydraulic actuator 87, and the hydraulic oil flows out from the low-speed-side hydraulic chambers $78_L$, $88_L$, whereby the actuator drivers 79, 89 of the intake-side hydraulic actuator 77 and the exhaust-side hydraulic actuator 87 simultaneously shift rightward. Therefore, the intake-side switch drive shaft 71 and the exhaust-side switch drive shaft 81 respectively integrally fitted to the actuator drivers 79, 89 also simultaneously shift rightward (RH).

As described above, when the electromagnetic solenoid 92 of the linear solenoid valve 91 is not energized and the intake-side switch drive shaft 71 and the exhaust-side switch drive shaft 81 shift leftward (LH), in the intake-side cam switch mechanism 70 shown in FIG. 12, the first switch pin 73 of each direct-acting cam mechanism Ca is at the advanced position abutting on the recessed curved surface 71Cv of the intake-side switch drive shaft 71, while the second switch pin 74 is at the retracted position abutting on the flat surface 71Cp in the cam surface 71C.

The advanced first switch pin 73 engages with the annular lead groove 44*c* of the lead groove cylindrical part 43D of corresponding intake-side cam carrier 43 shifted rightward. The intake-side cam carrier 43 does not axially shift and maintained at a right-side predetermined position.

When each intake-side cam carrier 43 is at a right-side predetermined position (the low-speed-side position), as shown in FIG. 12, the low-speed-side cam lobe 43B acts on the intake rocker arm 72, and the intake valve 41 operates in accordance with the low-speed-side valve actuation characteristic set on the cam profile of the low-speed-side cam lobe 43B.

That is, the engine E is in the low-speed drive state.

Figure 13:
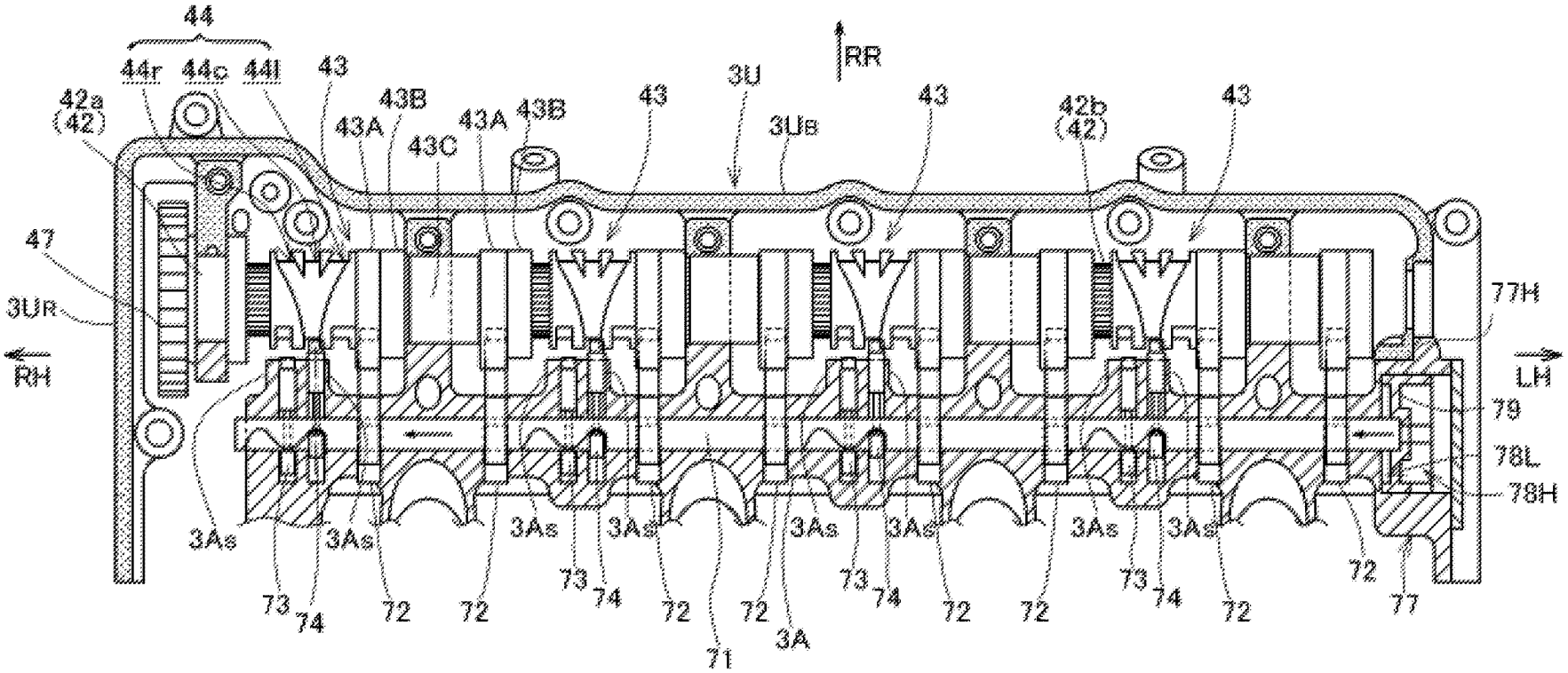
FIG. 13 is an explanatory view showing the operation state of main members of the intake-side cam switch mechanism in a high-speed drive mode of the engine.

From this state, when the electromagnetic solenoid 92 of the linear solenoid valve 91 is energized and the intake-side switch drive shaft 71 shifts rightward, with reference to FIG. 13, the truncated cone end surface 73*bt* of the first switch pin 73 ascends the slope of the recessed curved surface 71Cv from the center of the recessed curved surface 71Cv thereby retracted, to abut on the flat surface 71Cp. The truncated cone end surface 74*bt* of the second switch pin 74 descends the slope of the recessed curved surface 71Cv from the flat surface 71Cp thereby advancing, to abut on the center of the recessed curved surface 71Cv.

Accordingly, the retracted first switch pin 73 disengages from the annular lead groove 44*c* of the intake-side cam carrier 43, and the advanced second switch pin 74 engages with the left shift lead groove 44*l*. Therefore, the intake-side cam carrier 43 shifts axially leftward while rotating as being guided by the left shift lead groove 44*l* and, as shown in FIG. 13, the second switch pin 74 shifts from the left shift lead groove 44*l* to the annular lead groove 44*c* to engage therewith, while the intake-side cam carrier 43 is maintained at a left-side predetermined position.

When each intake-side cam carrier 43 is at the left-side predetermined position (the high-speed-side position), as shown in FIG. 13, the high-speed-side cam lobe 43A acts on the intake rocker arm 72, and the intake valve 41 operates in accordance with the high-speed-side valve actuation characteristic set on the cam profile of the high-speed-side cam lobe 43A.

That is, the engine E is in the high-speed drive state.

From this high-speed drive state, when the intake-side switch drive shaft 71 shifts leftward, the second switch pin 74 retracts and disengages with the annular lead groove 44*c*, while the first switch pin 73 advances and engages with the right shift lead groove 44*r*. Therefore, the intake-side cam carrier 43 shifts axially rightward while rotating as being guided by the right shift lead groove 44*r* and, as shown in FIG. 12, the low-speed drive state is entered where the intake-side cam carrier 43 is maintained at a right-side predetermined position (the low-speed-side position) and the low-speed-side cam lobe 43B acts on the intake rocker arm 72.

Similarly to the operation of the intake-side cam switch mechanism 70 by shifting of the intake-side switch drive shaft 71 corresponding to energization and cancelling the energization of the electromagnetic solenoid 92 of the linear solenoid valve 91 described above, the exhaust-side cam switch mechanism 80 similarly operates by shifting of the exhaust-side switch drive shaft 81.

In the following, with reference to FIGS. 2 and 3 and 14 to 24, a description will be given of the oil passage for supplying oil to the valve gear.

An oil pump 20 is disposed toward the oil pan 5 in the rear part of the lower crankcase 1L (see FIG. 2).

With reference to FIGS. 2 and 3, the cylinder block 2, the cylinder head 3, and the cylinder head cover 4 stacked on the upper crankcase 1U of the crankcase 1 extend upward along the cylinder axis Lc as being slightly inclined frontward from the crankcase 1.

Figure 24:
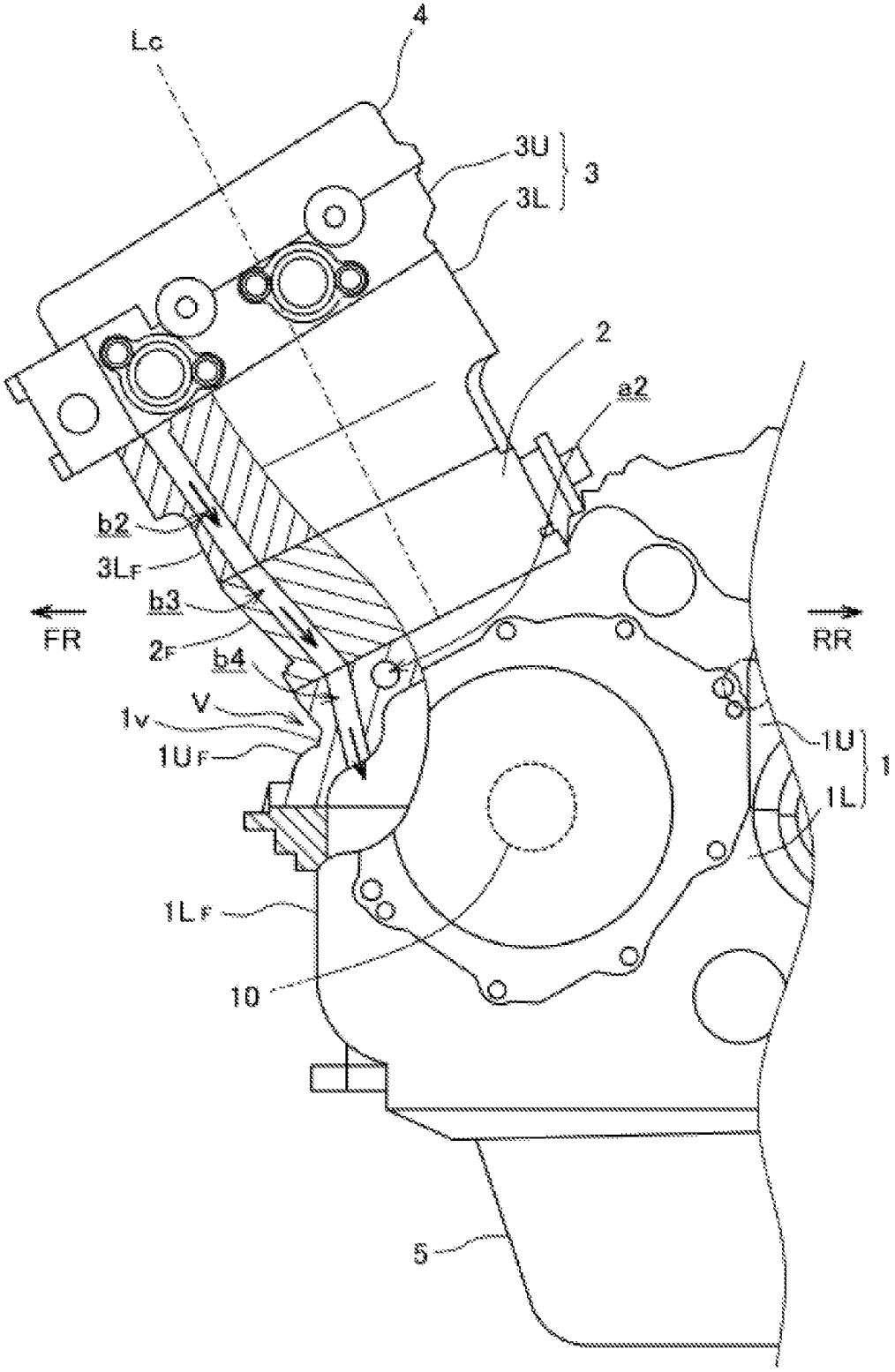
FIG. 24 is a left side view showing the cross section of the front part of the engine body of the engine.

Accordingly, as shown in FIG. 24, along a bent part 1*v* formed by the substantially vertical wall of a case front wall $1U_F$ of the upper crankcase 1U and a frontward-inclined cylinder front wall $2_F$ of the cylinder block 2, a valley part V is formed oriented in the right-left direction.

With reference to FIG. 3, an oil filter 21 is mounted on the front surface of the lower crankcase 1L at the lower rightward part.

The oil pump 20 pumps up oil accumulated in the oil pan 5, and sends under pressure the oil to the oil filter 21 via a not-shown oil passage.

Figure 14:
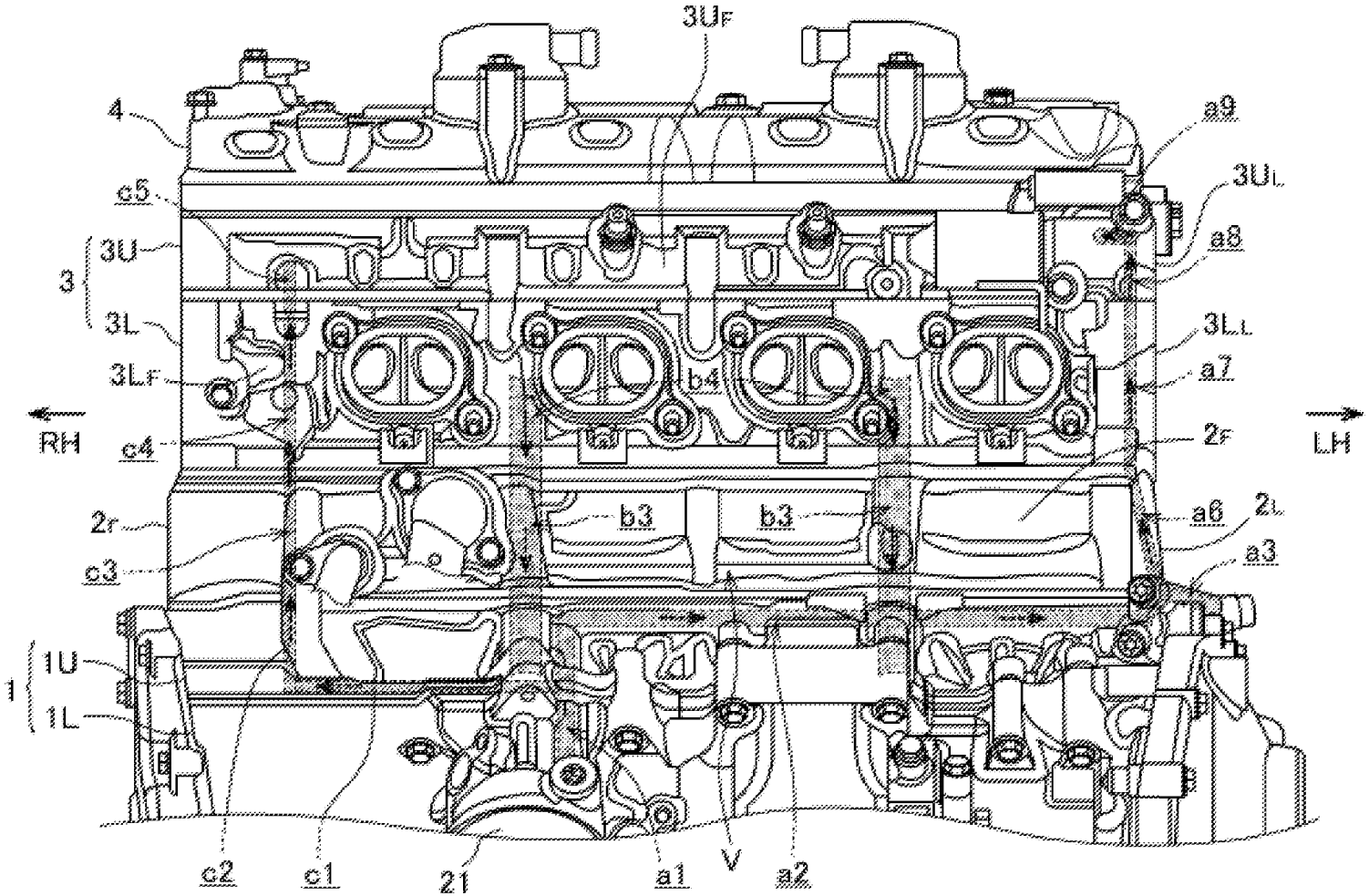
FIG. 14 is a front view of the engine.

With reference to FIGS. 3 and 14, from the oil filter 21, a first oil supply passage a1 is formed along a case front wall $1L_F$ of the lower crankcase 1L and the front surface of the case front wall $1U_F$ of the upper crankcase 1U upward, and toward the inside of the valley part V at the front surface of the case front wall $1U_F$ of the upper crankcase 1U.

From the downstream end of the first oil supply passage a1 reaching the inside of the valley part V of the upper crankcase 1U, a second oil supply passage a2 which is a right-left direction oil passage is formed at the case front wall $1U_F$ of the upper crankcase 1U, extending leftward along the valley part V near the bent part 1*v* which forms the valley part V.

Figure 15:
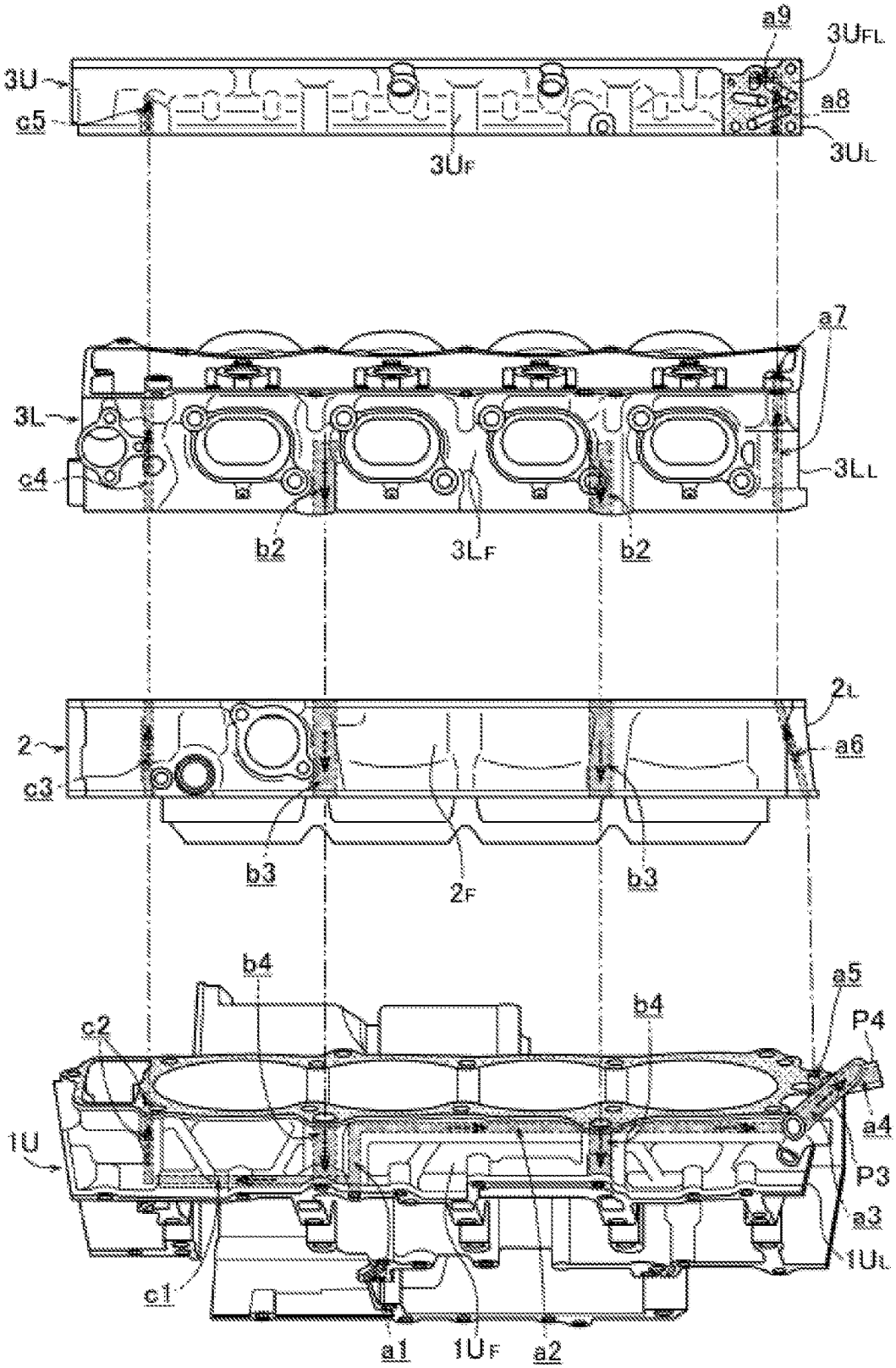
FIG. 15 is an exploded front view of an engine body of the engine.
Figure 16:
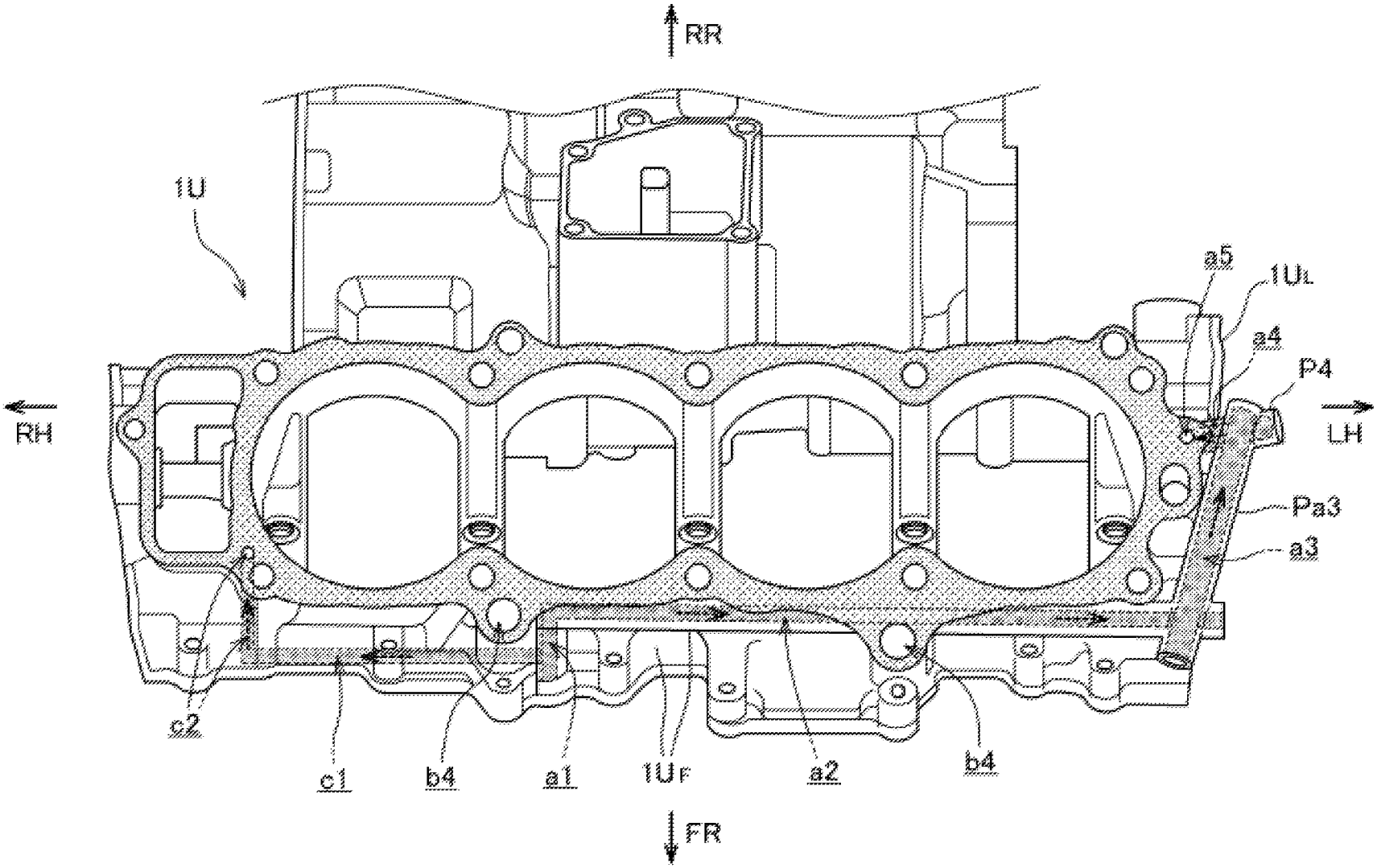
FIG. 16 is a top view of an upper crankcase.

With reference to the upper crankcase 1U shown in FIGS. 15 and 16, from the left end, which is the downstream end, of the second oil supply passage a2, a third oil supply passage a3 which is a front-rear direction oil passage extending rearward along a left side wall $1U_L$ of the upper crankcase 1U is formed.

The third oil supply passage a3 is formed as an outer piping where an oil passage pipe Pa3 which forms the third oil supply passage a3 is exposed outside.

The third oil supply passage a3 is formed along the left side wall $1U_L$ opposite to the right side wall of the upper crankcase 1U where the cam chain chamber 3*c* having the cam chain 66 disposed therein is formed.

From the rear end, which is the downstream end, of the third oil supply passage a3, a fourth oil supply passage a4 extending toward the inner side of the left side wall $1U_L$ of the upper crankcase 1U is formed.

From the fourth oil supply passage a4, a fifth oil supply passage a5 extending upward is formed at the left side wall $1U_L$ of the upper crankcase 1U. The fifth oil supply passage a5 opens at the matching surface relative to the cylinder block 2 of the upper crankcase 1U.

At a left side wall $2_L$ of the cylinder block 2, the sixth oil supply passage a6 which is a body top-bottom direction oil passage extending in the top-bottom direction is formed. The sixth oil supply passage a6 has its lower end opened at the matching surface relative to the upper crankcase 1U and matched with the upper end opening of the fifth oil supply passage a5 at the upper crankcase 1U, to establish communication with the fifth oil supply passage a5.

The sixth oil supply passage a6 has its upper end opened at the matching surface relative to the lower cylinder head 3L of the cylinder block 2.

At a left side wall $3L_L$ of the lower cylinder head 3L, a seventh oil supply passage a7 which is a body top-bottom direction oil passage extending in the top-bottom direction is formed. The seventh oil supply passage a7 has its lower end opened at the matching surface relative to the cylinder block 2 and matched with the upper end opening of the sixth oil supply passage a6 at the cylinder block 2, to establish communication with the sixth oil supply passage a6.

The seventh oil supply passage a7 has it upper end opened at the matching surface relative to the upper cylinder head 3U of the lower cylinder head 3L.

At the left side wall $3U_L$ of the upper cylinder head 3U, an eighth oil supply passage a8 which is a head top-bottom direction oil passage extending in the top-bottom direction is formed. The eighth oil supply passage a8 has its lower end opened at the matching surface relative to the lower cylinder head 3L and matched with the upper end opening of the seventh oil supply passage a7 at the lower cylinder head 3L, to establish communication with the seventh oil supply passage a7.

While the lower end of the eighth oil supply passage a8 opens at the matching surface, the upper end thereof is bent frontward, to form a ninth oil supply passage a9.

The ninth oil supply passage a9 extends substantially horizontally and frontward from the upper end of the eighth oil supply passage a8, and has its front end opened at the left-end matching surface $3U_{FL}$ at the front surface of the front side wall 3Fr of the upper cylinder head 3U.

That is, with reference to FIG. 10, the ninth oil supply passage a9 corresponds to the hydraulic pressure supply passage $90_L$, and opens at the left-end matching surface $3U_{FL}$ at the front surface of the upper cylinder head 3U where the linear solenoid valve 91 is mounted.

The sixth oil supply passage a6 and the seventh oil supply passage a7, each of which is a body top-bottom direction oil passage, are formed to extend in the top-bottom direction along the left side walls $2_L$, $3L_L$ of the cylinder block 2 and the lower cylinder head 3L, respectively.

The sixth oil supply passage a6 and the seventh oil supply passage a7, each of which is a body top-bottom direction oil passage, are formed at the left side walls $2_L$, $3L_L$ of the cylinder block 2 and the lower cylinder head 3L, which left side walls $2_L$, $3L_L$ are opposite to the right side walls where the cam chain 66 is disposed.

Figure 21:
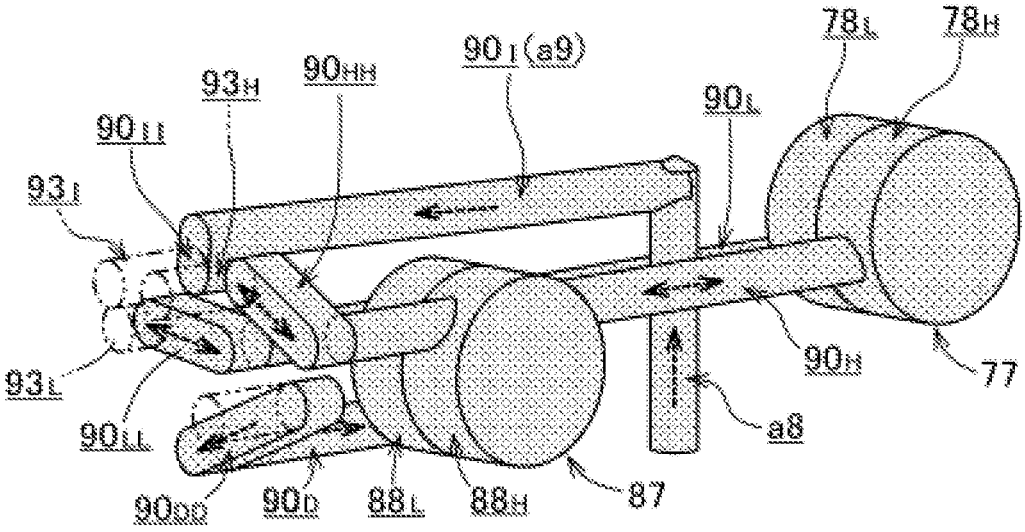
FIG. 21 is a perspective view showing just the channel of oil in a left side wall of the upper cylinder head.
Figure 22:
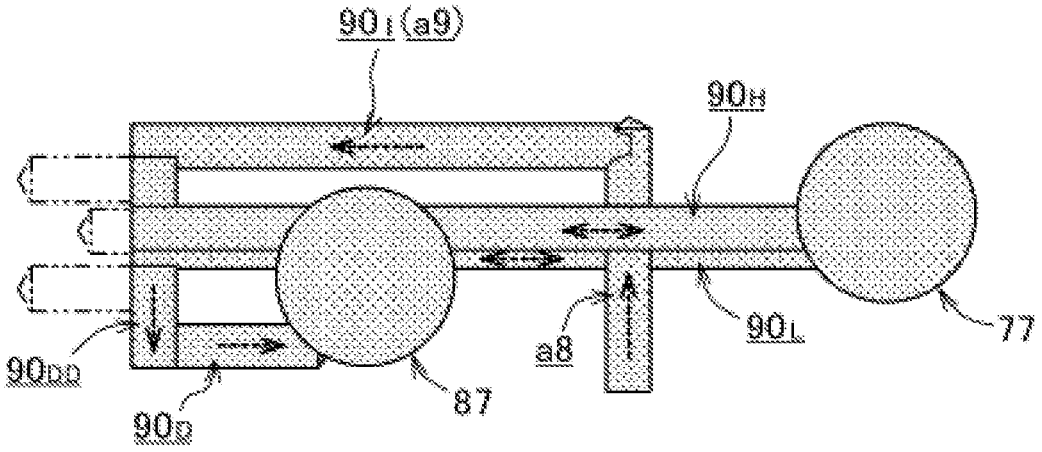
FIG. 22 is a left side view showing just the channel of the oil.
Figure 23:
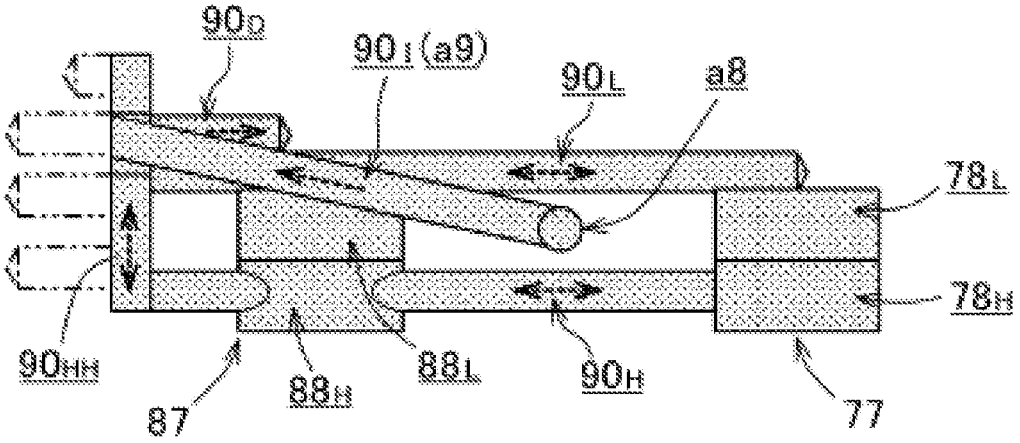
FIG. 23 is a top view showing just the channel of the oil.

FIGS. 21 to 23 show just the channel of oil in a left side wall 3U of the upper cylinder head 3U.

The low-speed-side hydraulic chamber $88_L$ and the high-speed-side hydraulic chamber $88_H$ of the exhaust-side hydraulic actuator 87, and the low-speed-side hydraulic chamber $78_L$ and the high-speed-side hydraulic chamber $78_H$ of the intake-side hydraulic actuator 77 are juxtaposed to each other on the front and rear sides. The low-speed-side supply and discharge oil passage $90_L$, establishes communication between the low-speed-side hydraulic chambers $78_L$, $88_L$. The high-speed-side supply and discharge oil passage $90_H$ establishes communication between the high-speed-side hydraulic chambers $78_H$, $88_H$.

The low-speed-side supply and discharge oil passage $90_L$ and the high-speed-side supply and discharge oil passage $90_H$ extend frontward, and respectively communicate with the long groove $90_{LL}$ and the long groove $90_{HH}$ opening at the left-end matching surface $3U_{FL}$ of the upper cylinder head 3U.

The low-speed-side supply and discharge oil passage $90_L$ and the high-speed-side supply and discharge oil passage $90_H$ are oriented in the front-rear direction and disposed parallel to each other on the right and left side. The eighth oil supply passage a8 is disposed to penetrate in the top-bottom direction between the low-speed-side supply and discharge oil passage $90_L$ and the high-speed-side supply and discharge oil passage $90_H$.

The ninth oil supply passage a9 (the hydraulic pressure supply passage 900 extending frontward from the upper end of the eighth oil supply passage a8 communicates with the long groove $90_H$ opening at the left-end matching surface $3U_{FL}$ of the upper cylinder head 3U.

From the long groove $90_{DD}$ opening at the left-end matching surface $3U_{FL}$, the drain oil passage $90_D$ extends rearward.

By the above-described oil supply passage structure for the actuators, oil filtered and flowing out from the oil filter 21 flows upward through the first oil supply passage al at the front wall $1U_F$ of the upper crankcase 1U, thereafter flows leftward through the second oil supply passage a2 along the valley part V. Thereafter, the oil flows rearward through the third oil supply passage a3 along the left side wall $1U_L$ of the upper crankcase 1U. Next, the oil flows through the fourth oil supply passage a4 and the fifth oil supply passage a5. Subsequently, from the fifth oil supply passage a5, the oil successively flows upward through the sixth oil supply passage a6 at the left side wall $2_L$ of the cylinder block 2, the seventh oil supply passage a7 at the left side wall $3L_L$ of the lower cylinder head 3L, and the eighth oil supply passage a8 at the left side wall $3U_L$ of the upper cylinder head 3U.

At the left side wall $3U_L$ of the upper cylinder head 3U, the oil reaching the upper end of the eighth oil supply passage a8 flows frontward in the ninth oil supply passage a9 (the hydraulic pressure supply passage 900, to flow into the sleeve 93 of the linear solenoid valve 91.

The oil having flowed into the sleeve 93 of the linear solenoid valve 91 is controlled by the linear solenoid valve 91, and supplied to the intake-side hydraulic actuator 77 and the exhaust-side hydraulic actuator 87 by the low-speed-side supply and discharge oil passage $90_L$ or the high-speed-side supply and discharge oil passage $90_H$, whereby the intake-side hydraulic actuator 77 and the exhaust-side hydraulic actuator 87 drive.

Figure 20:
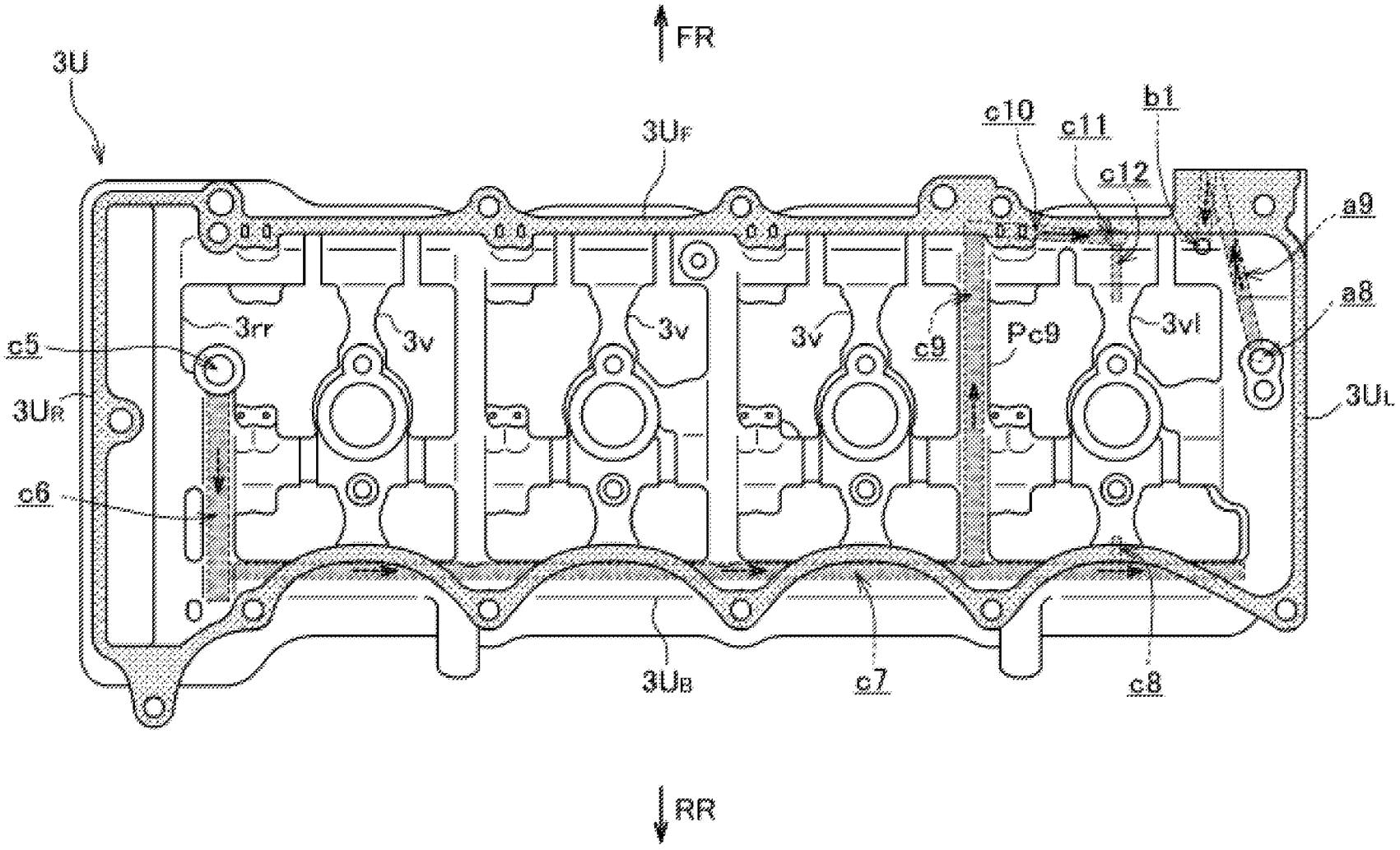
FIG. 20 is a bottom view of the upper cylinder head.

The drain oil passage $90_D$ of the upper cylinder head 3U is bent downward at a position slightly rearward from the long groove $90_{DD}$, and opens downward as an oil discharge port (the first return oil passage) b1 (see FIG. 20).

Figure 18:
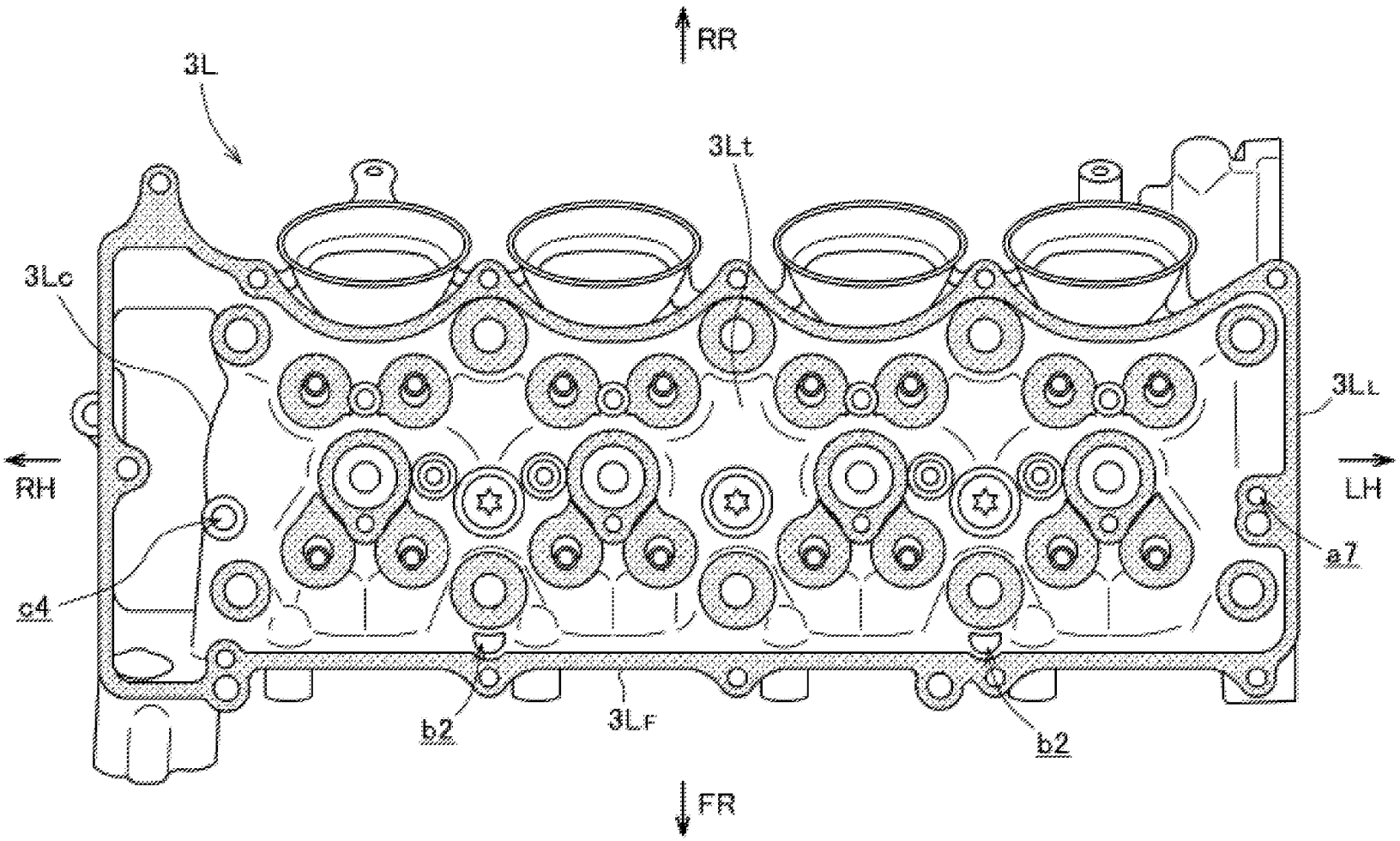
FIG. 18 is a top view of a lower cylinder head.

The oil discharged from the oil discharge port b1 is poured onto the upper surface of an upper lid wall 3Lt which forms the combustion chamber 30 of the lower cylinder head 3L show in FIG. 18.

The lower cylinder head 3L is inclined frontward and the upper lid wall 3Lt is lowered frontward. Therefore, the oil discharged onto the upper surface of the upper lid wall 3Lt flows frontward, and accumulated at the corner formed by the upper lid wall 3Lt and the front wall $3L_F$.

With reference to FIGS. 15 and 18, right and left two second return oil passages b2 which open at the corner formed by the upper lid wall 3Lt and the front wall $3L_F$ of the lower cylinder head 3L and extend below the front wall $3L_F$ are formed.

Figure 17:
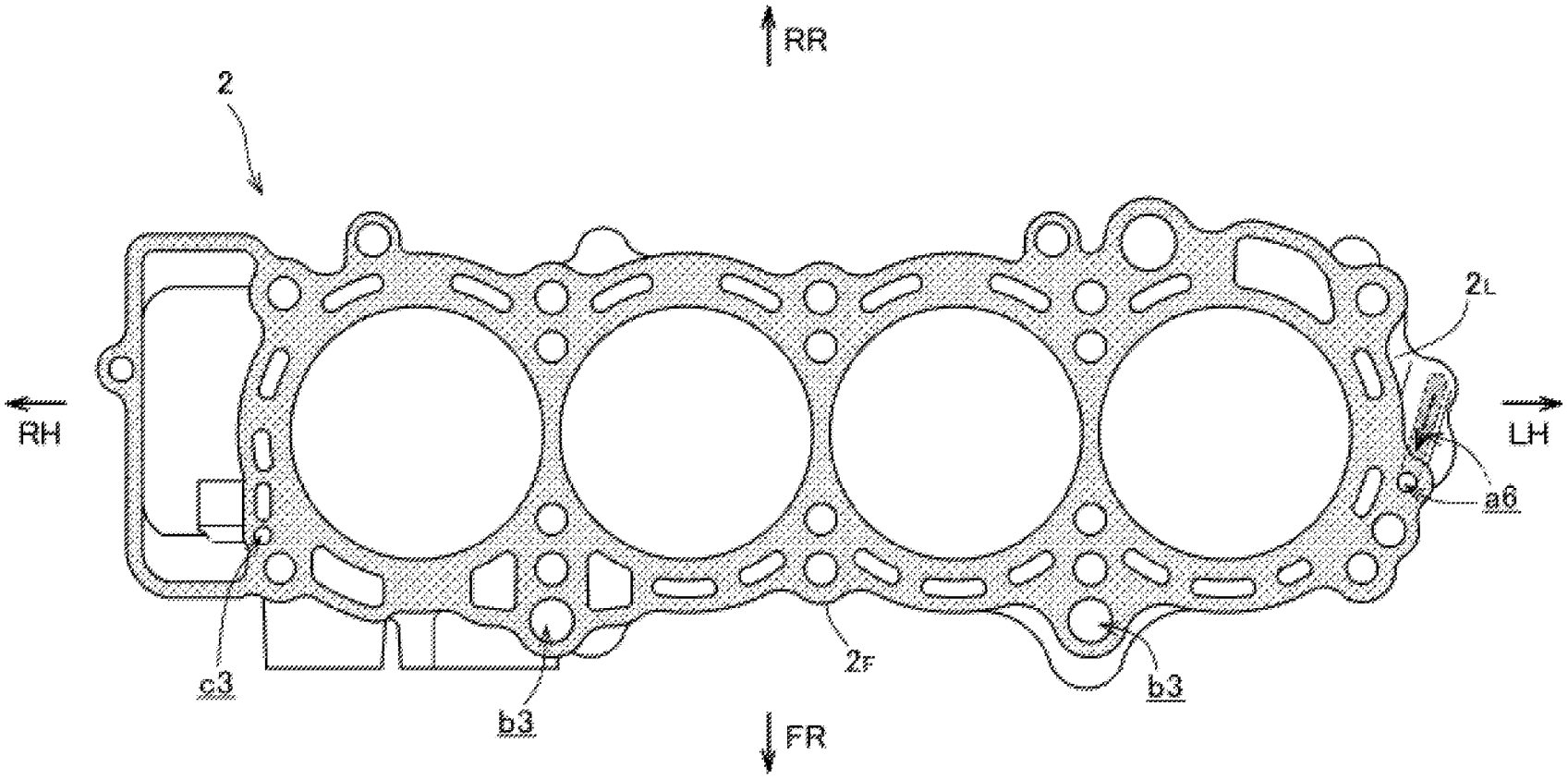
FIG. 17 is a top view of a cylinder block.

With reference to FIGS. 15 and 17, at the front wall $2_F$ of the cylinder block 2 connected to the lower cylinder head 3L from beneath, right and left third return oil passage b3 communicating with the second return oil passages b2 are formed to extend downward.

With reference to FIGS. 15 and 16, at the front wall $1U_F$ of the upper crankcase 1U connected to the cylinder block 2 from beneath, right and left two fourth return oil passages b4 communicating with the third return oil passages b3 are formed to extend downward.

As shown in FIG. 24, the second, third, and fourth return oil passages b2, b3, b4 are formed in the top-bottom direction inclined obliquely frontward along the front wall of the engine body.

Relative to the inclined third return oil passages b3 at the cylinder block 2, the fourth return oil passages b4 at the upper crankcase 1U further extend downward while bending nearly vertically, and have their ends opened in the crankshaft chamber.

Accordingly, oil discharged from the oil discharge port (the first return oil passage) b1 of the upper cylinder head 3U flows through the second return oil passages b2 at the lower cylinder head 3L, the third return oil passages b3 at the cylinder block 2, and the fourth return oil passages b4 at the upper crankcase 1U, to return to the oil pan 5 from the crankshaft chamber.

Note that, as shown in FIG. 24, in the upper crankcase 1U, on the inner side (on the rear side) relative to the fourth return oil passages b4, the second oil supply passages a2 each of which is a right-left direction oil passage extending in the right-left direction along the valley part V are positioned.

Next, a description will be given of the oil passage structure for supplying oil to the bearings of the intake-side camshaft 42 and the exhaust-side camshaft 52 of the variable valve gear 40.

The intake-side camshaft 42 and the exhaust-side camshaft 52 which are parallel to each other are oriented in the right-left direction and rotatably pivotally supported as being fit to the bearing surfaces 3*vf* forming semi-arc surfaces of the plurality of bearing walls 3*v*, 3*vr* of the upper cylinder head 3U and set in the camshaft holder 33.

With reference to FIG. 3, branching from an intermediate part in the first oil supply passage a1 extending upward from the oil filter 21 mounted on the front surface of the lower crankcase 1L along the front surface of the case front wall $1L_F$ of the lower crankcase 1L and the case front wall $1U_F$ of the upper crankcase 1U, a first oil supply passage cl extends rightward in the case front wall $1U_F$ of the upper crankcase 1U.

The first oil supply passage cl of the upper crankcase 1U is bent at the right end and extends upward as a second oil supply passage c2.

The second oil supply passage c2 of the upper crankcase 1U has its upper opening opened at the matching surface relative to the cylinder block 2.

At the right part of the front wall $2_F$ of the cylinder block 2, a third oil supply passage c3 extending in the top-bottom direction is formed. The third oil supply passage c3 has its lower end opened at the matching surface relative to the upper crankcase 1U and matched with the upper end opening of the second oil supply passage a2 of the upper crankcase 1U, to establish communication with the second oil supply passage a2.

The third oil supply passage c3 has its upper end opened at the matching surface relative to the lower cylinder head 3L of the cylinder block 2.

At the inner wall 3Lc of the cam chain chamber 3*c* of the lower cylinder head 3L, a fourth oil supply passage c4 extending in the top-bottom direction is formed The fourth oil supply passage c4 has its lower end opened at the matching surface relative to the cylinder block 2 and matched with the upper end opening of the third oil supply passage a3 of the cylinder block 2, to establish communication with the third oil supply passage a3.

The fourth oil supply passage c4 has its upper end opened at the matching surface relative to the upper cylinder head 3U of the lower cylinder head 3L.

In the upper cylinder head 3U, between the front wall $3U_F$ and the rear wall $3U_B$ opposing to each other, five bearing walls 3*v* (3*vr*) are arranged in the right-left direction. The intake-side camshaft 42 and the exhaust-side camshaft 52 oriented in the right-left direction are rotatably pivotally supported as being fit to the front and rear bearing surfaces 3*vf* of the bearing walls 3*v* (3*vr*, 3*vl*) and set in the camshaft holder 33 (see FIGS. 4 and 5).

Figure 19:
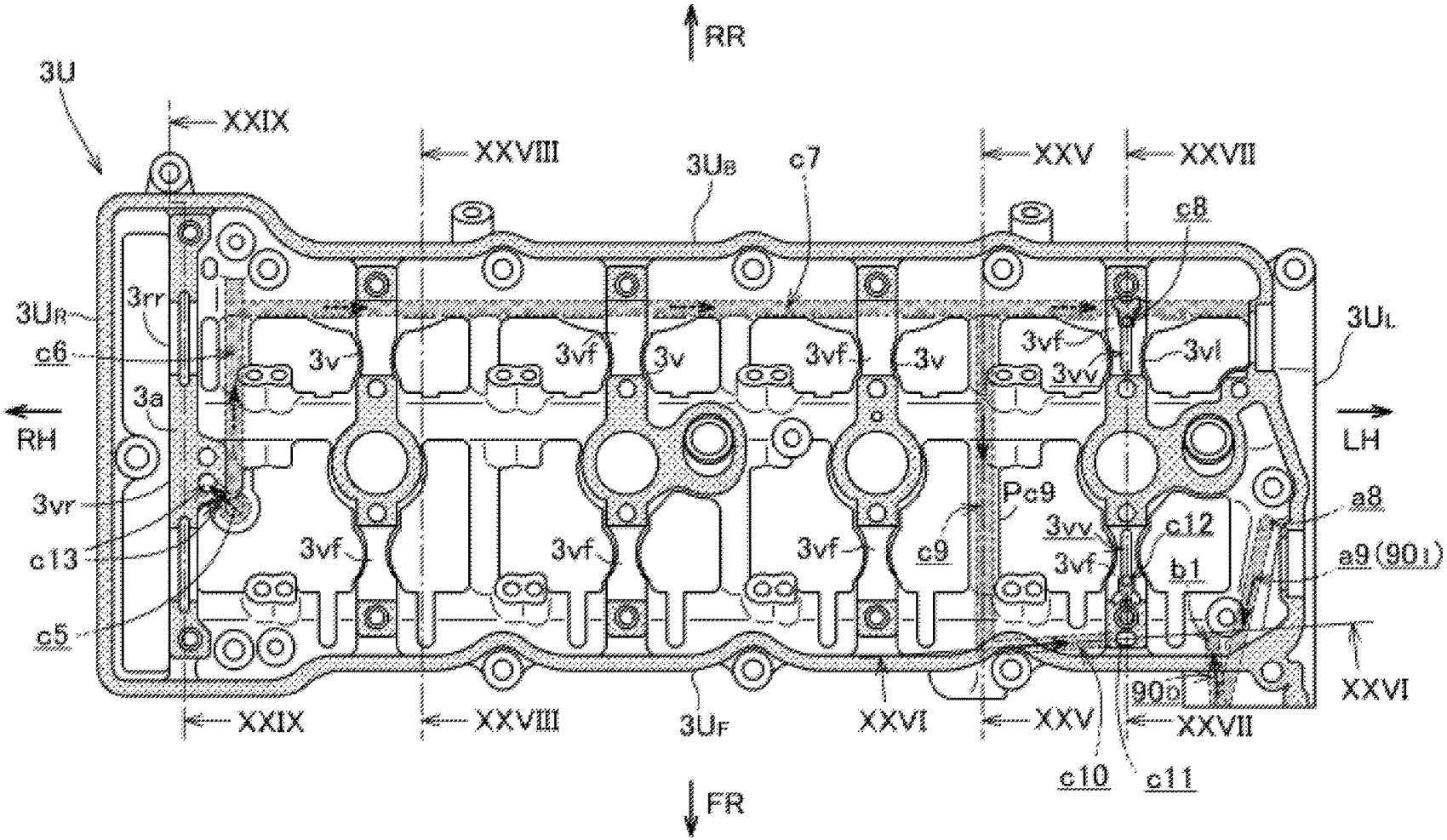
FIG. 19 is a top view of the upper cylinder head.

With reference to the upper cylinder head 3U shown in FIG. 15 and FIGS. 19 and 20, at the rightmost bearing wall 3*vr* along the cam chain chamber 3*c* of the upper cylinder head 3U, a fifth oil supply passage c5 extending upward from the lower surface is formed. The fifth oil supply passage c5 has its lower end opened at the matching surface relative to the lower cylinder head 3L and matched with the upper end opening of the fourth oil supply passage c4 of the lower cylinder head 3L, to establish communication with the fourth oil supply passage a4.

The fifth oil supply passage c5 has its upper end closed. From this upper end, a sixth oil supply passage c6 extends rearward to reach the rear wall $3U_B$.

At the rear wall $3U_B$ of the upper cylinder head 3U, a seventh oil supply passage c7 extending leftward from the rightmost bearing wall 3*vr* to the leftmost bearing wall 3*vl* is formed.

That is, the seventh oil supply passage c7 is formed at the rear wall $3U_B$ opposite to the front wall $3U_F$ where the exhaust tube 125 extends.

The right end of the seventh oil supply passage c7 communicates with the sixth oil supply passage c6.

Figure 25:
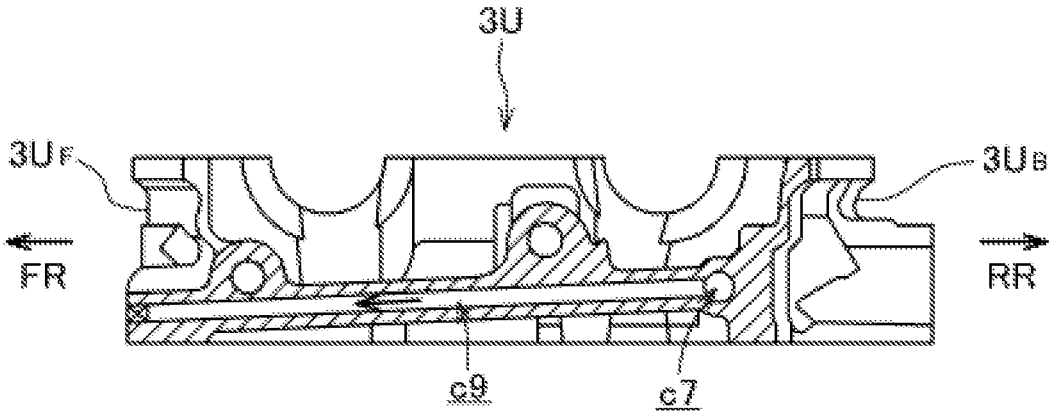
FIG. 25 is a cross-sectional view of the upper cylinder head taken along line XXV-XXV in FIG. 19.
Figure 27:
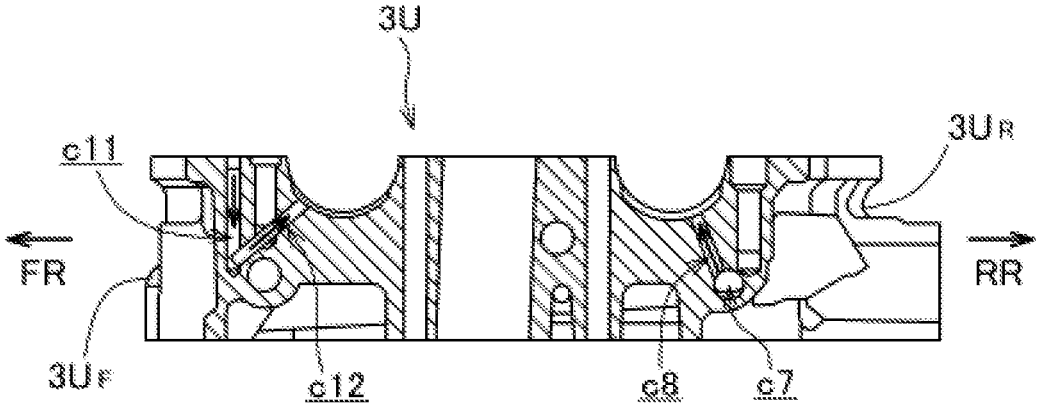
FIG. 27 is a cross-sectional view of the upper cylinder head taken along line XXVII-XXVII in FIG. 19.
Figure 28:
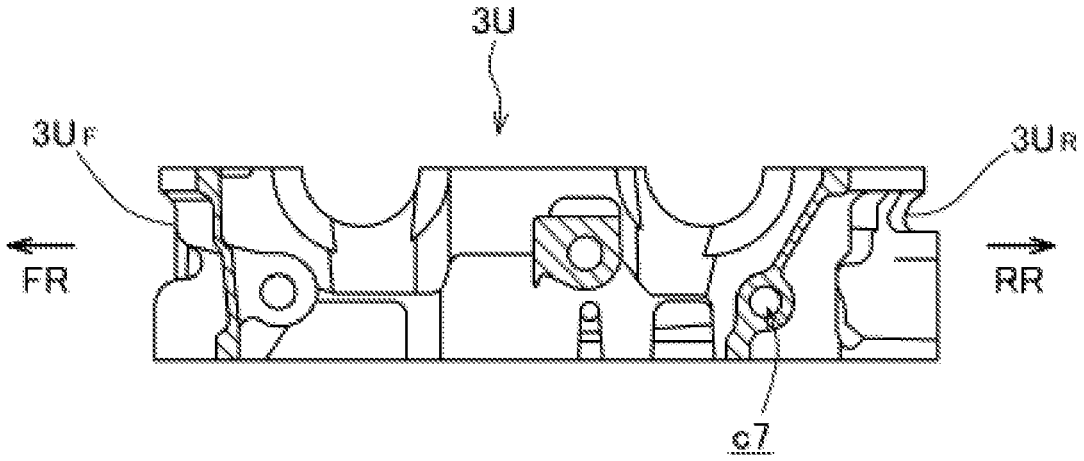
FIG. 28 is a cross-sectional view of the upper cylinder head taken along line XXVIII-XXVIII in FIG. 19.
Figure 29:
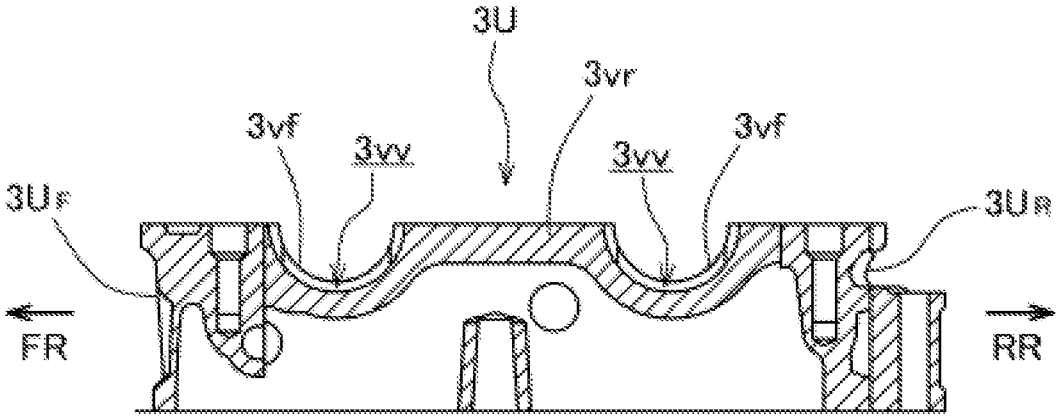
FIG. 29 is a cross-sectional view of the upper cylinder head taken along line XXIX-XXIX in FIG. 19.

As shown in FIGS. 25 and 27, the seventh oil supply passage c7 is provided lower than the semi-arc-like bearing surfaces 3*vf* of the bearing walls 3*v*.

At each of the front and rear bearing surfaces 3*vf* of the leftmost bearing wall 3*rl*, an arc groove 3*vv* is formed along the arc surface.

With reference to FIG. 27, in the bearing wall 3*rl*, branching from the seventh oil supply passage c7, an eighth oil supply passage c8 extends obliquely upward, and has its upper end opened at the arc groove 3*vv* of the rear bearing surface 3*vf*.

With reference to FIG. 19, a coupling oil passage pipe Pc9 is provided across the rear wall $3U_B$ where the seventh oil supply passage c7 is provided and the front wall $3U_F$. The coupling oil passage pipe Pc9 is integrated with the rear wall $3U_B$ and the front wall $3U_F$.

The coupling oil passage pipe Pc9 is provided on the right side of the leftmost bearing wall 3*rl*. As shown in FIGS. 19 and 25, a ninth oil supply passage c9 branched from the seventh oil supply passage c7 is formed at the coupling oil passage pipe Pc9.

As shown in FIG. 25, the ninth oil supply passage c9 extends slightly downward frontward from the seventh oil supply passage c7 on the rear wall $3U_B$ to reach the front wall $3U_F$.

Figure 26:
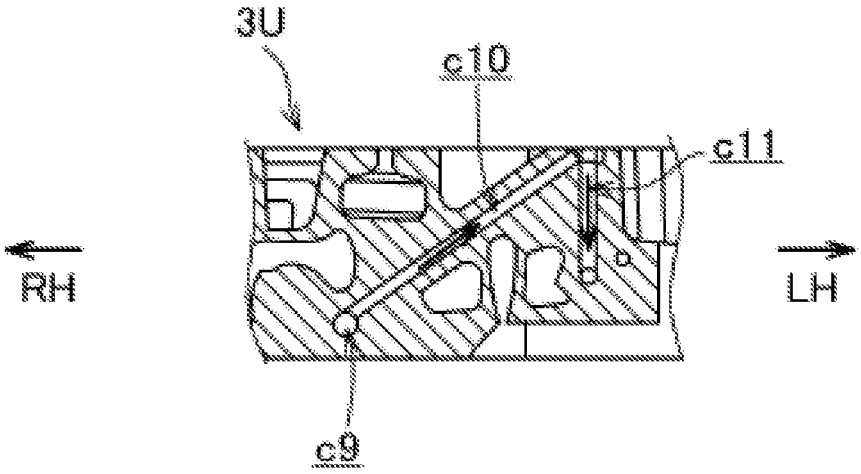
FIG. 26 is a cross-sectional view of the upper cylinder head taken along line XXVI-XXVI in FIG. 19.

As shown in FIG. 26, at the rear wall $3U_B$, a tenth oil supply passage c10 extends leftward and obliquely upward from the front end of the ninth oil supply passage c9 to reach the bearing wall 3*rl*.

From the upper end of the tenth oil supply passage c10, an eleventh oil supply passage c11 extends downward (see FIG. 26).

With reference to FIG. 27, from the lower end of the eleventh oil supply passage c11, a twelfth oil supply passage c12 extends obliquely upward, and has its upper end opened at the arc groove 3*vv* of the front bearing surface 3*vf* of the bearing wall 3*rl*.

Thus, the ninth oil supply passage c9, the tenth oil supply passage c10, the eleventh oil supply passage c11, and the twelfth oil supply passage c12 are integrally formed at the upper cylinder head 3U.

As shown in FIG. 5, the intake-side camshaft 42 and the exhaust-side camshaft 52 are pivotally supported by the five bearing walls 3*v* (3*vr*, 3*vl*) at the upper cylinder head 3U. Below the lead groove cylindrical part 43D adjacent to the cam lobes 43A, 43B of the intake-side cam carrier 43 fitted axially slidably to the intake-side camshaft 42 and the lead groove cylindrical part 53D adjacent to the cam lobes 53A, 53B of the exhaust-side cam carrier 53 axially slidably fitted to the exhaust-side camshaft 52, the coupling oil passage pipe Pc9 is positioned.

With reference to FIG. 19, branching from the fifth oil supply passage c5 oriented in the top-bottom direction at the bearing wall 3*vr* of the upper cylinder head 3U, a thirteenth oil supply passage c13 upwardly extends and has its upper end opened at the matching surface 3*a* of the bearing wall 3*vr*.

The camshaft holder 33 has its matching surface 33*a* matched with this bearing wall 3*vr*, whereby intake-side camshaft 42 and the exhaust-side camshaft 52 are pivotally supported as being set therein.

Figure 30:
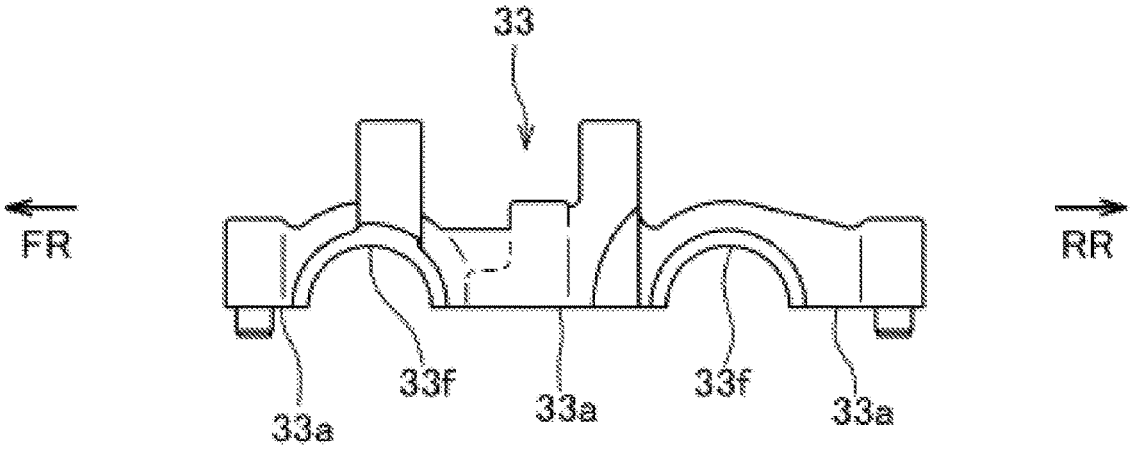
FIG. 30 is a left side view of a camshaft holder.
Figure 31:
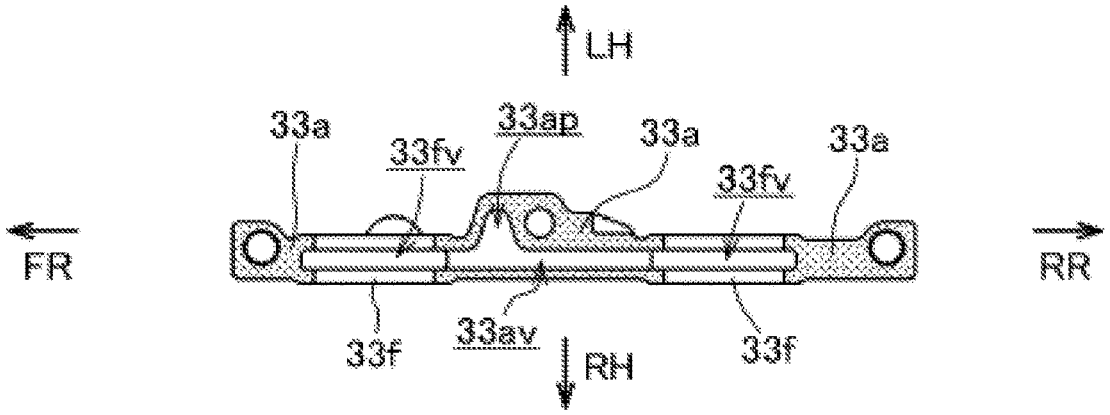
FIG. 31 is a bottom view of the camshaft holder.

With reference to FIGS. 30 and 31, the camshaft holder 33 includes bearing surfaces 33*f*, 33*f* each having a semi-arc surface opposing to the front and rear bearing surfaces 3*vf*, 3*vf* of the bearing wall 3*vr* each having a semi-arc surface.

Along their respective arc surfaces, the bearing surfaces 33*f*, 33*f* are provided with arc grooves 33*fv*, 33*fv*.

At the matching surface 33*a* between the bearing surfaces 33*f*, 33*f* of the camshaft holder 33, a communication groove 33*av* establishing communication between the front and rear arc grooves 33*fv*, 33*fv* is formed.

One part of the communication groove 33*av* bulges leftward, to form a bulging part 33*ap*.

When the camshaft holder 33 is stacked on the bearing wall 3*vr*, the bulging part 33*ap* of the communication groove 33*av* of the camshaft holder 33 opposes to the upper end opening of the thirteenth oil supply passage c13 which opens at the matching surface 3*a* of the bearing wall 3*vr*.

Accordingly, from the thirteenth oil supply passage c13, oil flows out to the bulging part 33*ap* of the camshaft holder 33, and flows from the bulging part 33*ap* through the communication groove 33*av*, to be supplied to the front and rear arc grooves 33*fv*, 33*fv*. Thus, the oil lubricates the journal parts of the intake-side camshaft 42 and the exhaust-side camshaft 52.

By the above-described oil supply passage structure for the bearings of the camshafts, oil filtered by the oil filter 21 and flowing into the first oil supply passage al at the front wall 1$U_F$ of the upper crankcase 1U flows upward through the first oil supply passage a1, thereafter flows rightward through the first oil supply passage cl branched rightward from the first oil supply passage a1. At the right end of the first oil supply passage a1, the oil flows upward through the second oil supply passage c2. Subsequently, the oil successively flows through the third oil supply passage c3 of the cylinder block 2, the fourth oil supply passage c4 of the lower cylinder head 3L, and the fifth oil supply passage c5 of the upper cylinder head 3U.

In the upper cylinder head 3U, the oil reaching the upper end of the fifth oil supply passage c5 flows rearward through the sixth oil supply passage c6 formed at the bearing wall 3*vr*. Thereafter, the oil flows leftward through the seventh oil supply passage c7 formed at the rear wall 3$U_B$.

The oil having flowed through the seventh oil supply passage c7 flows into the eighth oil supply passage c8 which branches at the left bearing wall 3*vl*, and flows out to the arc groove 3*vv* of the rear bearing surface 3*vf* of the bearing wall 3*vl*. Thus, the oil lubricates the rear bearing surface 3*vf*.

Additionally, the oil having flowed through the seventh oil supply passage c7 branches into and flows frontward through the ninth oil supply passage c9 formed midway at the coupling oil passage pipe Pc9, to reach the front wall 3$U_F$. The oil successively flows through the tenth oil supply passage c10 and the eleventh oil supply passage c11 formed on the front wall 3$U_F$ side. Thereafter, the oil flows through the twelfth oil supply passage c12 formed at the bearing wall 3*vl*, and flows out to the arc groove 3*vv* of the front bearing surface 3*vf* of the bearing wall 3*vl*. Thus, the oil lubricates the front bearing surface 3*vf*.

At the right bearing wall 3*vr* of the upper cylinder head 3U, oil having flowed from the thirteenth oil supply passage c13 branched from the fifth oil supply passage c5 into the communication groove 33*av* of the camshaft holder 33 branches into the front and rear arc grooves 33*fv*, 33*fv*. Thus, the oil lubricates the front and rear bearing surfaces 33*f*, 33*f* of the camshaft holder 33 and the front and rear bearing surfaces 3*vf*, 3*vf* of the bearing wall 3*vr*.

The embodiment of the oil passage structure for an engine of the present invention described in detail exhibits the following effects.

As shown in FIG. 3, in the engine E including the engine body Eh formed of the crankcase 1 and the cylinder block 2 and the cylinder head 3 stacked on the crankcase 1 obliquely upward, integrally fastened inclined frontward, the matching surface of the case front wall 1$U_F$ of the crankcase and the matching surface of the cylinder front wall 2$_F$ of the cylinder block 2 form the valley part V by an obtuse angle. The second oil supply passage (the right-left direction oil passage) a2 extending in the right-left direction along the valley part V near the matching surfaces is formed. Thus, the second oil supply passage (the right-left direction oil passage) a2 is formed in a compact manner snugly along the valley part V, contributing to downsizing the engine E. By virtue of the second oil supply passage (the right-left direction oil passage) a2 being concealed in the valley part V, the oil passage is protected against any external forces such as a stone thrown up by other vehicle.

As shown in FIG. 24, the second oil supply passage (the right-left direction oil passage) a2 is formed at the case front wall 1$U_F$ of the crankcase 1. Therefore, protection against external forces improves than when the second oil supply passage (the right-left direction oil passage) a2 is formed at the cylinder front wall 2$_F$ of the cylinder block 2 which is inclined frontward.

As shown in FIG. 24, the second oil supply passage (the right-left direction oil passage) a2 is positioned on the inner side (the rear side) in the front wall 1$U_F$ than the return oil passage b4 which is formed to extend in the top-bottom direction of the engine body Eh. Therefore, the second oil supply passage (the right-left direction oil passage) a2 is not formed to bulge at the front surface of the front wall 1$U_F$, contributing to downsizing the engine E.

As shown in FIG. 3, out of the right and left side walls of the engine body Eh, the third oil supply passage (the front-rear direction oil passage) a3 formed at the left side wall 1$U_L$ to extend in the front-rear direction is an outer piping in which the oil passage pipe Pa3 forming the third oil supply passage (the front-rear direction oil passage) a3 is exposed outside. Therefore, the oil cooling effect is exhibited.

With reference to FIGS. 3 and 5, the third oil supply passage (the front-rear direction oil passage) a3 is formed at the left side wall 1$U_L$ of the engine body Eh which is opposite in the right-left direction to the right side wall where the cam chain 66 is provided. This prevents an increase in size of the right side wall where the cam chain 66 is provided attributed to the front-rear direction oil passage, which may otherwise increase the volume of the engine body Eh on the right side. Thus, the engine body Eh attains the laterally balanced structure.

As shown in FIG. 3, out of the right and left side walls of the engine body Eh, at the left side walls 2$_L$, 3$L_L$, 3$U_L$, the sixth, seventh, and eighth oil supply passages (the body top-bottom direction oil passages) a6, a7, a8 extending in the top-bottom direction along the side wall surfaces of the left side walls 2$_L$, 3$L_L$, 3$U_L$ are formed. Therefore, the left side walls 2$_L$, 3$L_L$, 3$U_L$ of the engine body Eh are effectively used in forming the sixth, seventh, and eighth oil supply passages (the body top-bottom direction oil passages) a6, a7, a8, contributing to downsizing the engine E.

With reference to FIGS. 3 and 5, the sixth, seventh, and eighth oil supply passages (the body top-bottom direction oil passages) a6, a7, a8 are formed at the left side walls 2$_L$, 3$L_L$, 3$U_L$ of the engine body Eh which left side walls are opposite in the right-left direction to the right side wall where the cam chain 66 is provided. This prevents an increase in size of the right side wall where the cam chain 66 is provided attributed to the body top-bottom direction oil passages, which may otherwise increase the volume of the engine body Eh on the right side Thus, the engine body Eh attains the laterally balanced structure.

The valve gear 40 is a variable valve gear which includes the camshafts 42, 52, the cam carriers 43, 53, and the cam switch mechanisms 70, 80. In the oil passage which supplies oil to the actuators 77, 87 of the cam switch mechanisms 70, 80, the eighth oil supply passage (the head top-bottom direction oil passage) a8 formed to extend in the top-bottom direction at the left side wall 3$U_L$ of the cylinder head 3U is disposed between a pair of low-speed-side supply and discharge oil passage 90$_L$ and high-speed-side supply and discharge oil passage 90$_H$ which supplies and discharges oil to and from the actuators. Thus, the space between the low-speed-side supply and discharge oil passage 90$_L$ and the high-speed-side supply and discharge oil passage 90$_H$ supplying and discharging oil to the actuators is effectively used in disposing the eighth oil supply passage (the head top-bottom direction oil passage) a8, contributing to downsizing the engine E.

In the foregoing, the description has been made of the oil passage structure for an engine according to one embodiment of the present invention. The mode of the present invention is not limited to the above-described embodiment, and the present invention may be practiced in various modes within the spirit of the present invention.

While the engine body of the engine according to the above-described embodiment includes the upper crankcase 1U and the cylinder block 2 separately from each other, the present invention is also applicable to an engine body including integrally formed upper crankcase 1U and cylinder block 2.

Furthermore, the vehicle of the present invention is not limited to the saddled two-wheel motorcycle 100 according to the embodiment, and applicable to any of various saddled vehicles including a motor scooter, three- or four-wheel motor buggy and the like. A vehicle which satisfies the requirements recited in claim 1 will suffice.

REFERENCE SIGNS LIST

Pu: power unit
E: engine
Eh: engine body
M: transmission
V: valley part
a1: first oil supply passage
a2: second oil supply passage (right-left direction oil passage)
a3: third oil supply passage (front-rear direction oil passage)
a4, a5: fourth, fifth oil supply passage
a6, a7, a8: sixth, seventh, eighth oil supply passage (body top-bottom direction oil passage)
a9: ninth oil supply passage
Pa3: oil passage pipe
b1, b2, b3, b4: first, second, third, fourth return oil passage
c1, c2, c3, c4, c5, c6: first, second, third, fourth, fifth, sixth oil supply passage
c7: seventh oil supply passage
c8: eighth oil supply passage
c9: ninth oil supply passage
c10: tenth oil supply passage
c11: eleventh oil supply passage
c12: twelfth oil supply passage
c13: thirteenth oil supply passage
Pc9: coupling oil passage pipe
1: crankcase
1L: lower crankcase
1$L_F$: case front wall
1U: upper crankcase
1$U_F$: case front wall
1*v:* bent part
1$U_L$: left side wall
2: cylinder block
2$_F$: front wall
2$_L$: left side wall
3: cylinder head
3L: lower cylinder head
3$L_F$: front wall
3U: upper cylinder head
3$U_F$: front wall
3$U_B$: rear wall
3$U_L$: left side wall
3$U_{FL}$: left-end matching surface
3*v,* 3*vr,* 3*vl:* bearing wall
3*c:* cam chain chamber
4: cylinder head cover
5: oil pan
7: stud bolt
10: crankshaft
11: main shaft
12: countershaft
20: oil pump
21: oil filter
30: combustion chamber
33: camshaft holder
40: variable valve gear
41: intake valve
42: intake-side camshaft
43: intake-side cam carrier
43A: high-speed-side cam lobe
43B: low-speed-side cam lobe
43D: lead groove cylindrical part
44: lead groove
44*c:* annular lead groove
44*l:* left shift lead groove
44*r:* right shift lead groove
47: intake-side driven gear
51: exhaust valve
52: exhaust-side camshaft
53: exhaust-side cam carrier
53A: high-speed-side cam lobe
53B: low-speed-side cam lobe
53D: lead groove cylindrical part
54: lead groove
54*c:* annular lead groove
54*l:* left shift lead groove
54*r:* right shift lead groove
57: exhaust-side driven gear
61: idle gear
62: idle chain sprocket
66: cam chain
70: intake-side cam switch mechanism
71: intake-side switch drive shaft
72: intake rocker arm
Ca: cam mechanism
73: first switch pin
74: second switch pin
75: coil spring
76: lid member
77: intake-side hydraulic actuator
78: intake-side actuator housing
79: intake-side actuator driver
79*h:* long hole
80: exhaust-side cam switch mechanism
81: exhaust-side switch drive shaft
82: exhaust rocker arm
Cb: cam mechanism
83: first switch pin
84: second switch pin
86: lid member
87: exhaust-side hydraulic actuator
88: exhaust-side actuator housing
89: exhaust-side actuator driver
89*h:* long hole
90$_H$: high-speed-side supply and discharge oil passage
90$_{HH}$: long groove
90$_L$: low-speed-side supply and discharge oil passage
90$_{RR}$: long groove
91: linear solenoid valve
92: electromagnetic solenoid
92*c:* electromagnetic coil
92*p:* plunger
93: sleeve

93R: matching surface
93$_I$: hydraulic pressure supply port
93$_H$: high-speed-side supply and discharge port
93$_L$: low-speed-side supply and discharge port
93$_D$: drain port
94: spool valve
94$_I$: hydraulic pressure supply groove
94$_D$: drain groove
95: spring
100: motorcycle
102: head pipe
103: main frame
104: seat rail
105: front fork
106: front wheel
107: pivot shaft
108: swingarm
109: rear wheel
110: link mechanism
111: rear cushion
112: driving sprocket
113: driven sprocket
114: roller chain
116: fuel tank
117: main seat
118: pillion seat
121: throttle body
122: air cleaner
125: exhaust tube

What is claimed is:

1. A motorcycle engine configured to be installed and transversely mounted in a frame of a motorcycle, the motorcycle engine comprising:

a crankcase having a case front wall, a cylinder block inclined frontward on the crankcase, the cylinder block having a cylinder front wall forming an obtuse angle with respect to the case front wall to form a valley part;

a cylinder head stacked on the cylinder block; and a valve gear disposed on the cylinder head, the valve gear comprising:

a camshaft oriented in a vehicle width direction and rotatably provided on the cylinder head, a cam carrier as a cylindrical member axially slidably fitting on an outer circumference of the camshaft while prohibited from relatively rotating, and a plurality of cam lobes, different in cam profile from each other formed axially adjacent to each other on an outer circumferential surface of the cam carrier, and a cam switch for axially shifting the cam carrier to switch a currently operational cam lobe acting on a valve, and an actuator for actuating operation of the cam switch, wherein the right-left direction oil passage supplies oil to the actuator of the cam switch, wherein:

the cylinder head comprises a head side wall, and a head top-bottom direction oil passage extending in a top-bottom direction along the head side wall, the head top-bottom direction oil passage arranged between a pair of supply and discharge oil passages which are respectively provided for supplying oil to, and discharging oil from the actuator, the crankcase has a right-left direction oil passage formed therein which supplies oil to the valve gear, the right-left direction oil passage extends in a right-left direction along the valley part, and the right-left direction oil passage is situated proximate the valley part.

2. The motorcycle engine according to claim 1, further comprising an oil pan disposed below the crankcase, wherein the crankcase has a return oil passage formed therein for returning oil from the cylinder head to the oil pan, the return oil passage extending in a top-bottom direction, and wherein the right-left direction oil passage is positioned inward in the crankcase in relation to the return oil passage.

3. The motorcycle engine according to claim 2, wherein the crankcase includes a first side wall and a second side wall opposite the first side wall, and wherein the engine comprises an oil passage pipe that is exposed outside of the crankcase, the oil passage pipe having a front-rear direction oil passage formed therein and extending in a front-rear direction along the first side wall.

4. The motorcycle engine according to claim 2, further comprising an engine body top-bottom direction oil passage extending in a top-bottom direction along a side wall of the cylinder block and a side wall of the cylinder head.

5. The motorcycle engine according to claim 1, wherein the crankcase includes a first side wall and a second side wall opposite the first side wall, and wherein the engine comprises an oil passage pipe that is exposed outside of the crankcase, the oil passage pipe having a front-rear direction oil passage formed therein and extending in a front-rear direction along the first side wall.

6. The motorcycle engine according to claim 5, further comprising a cam chain arranged proximate the second side wall.

7. The motorcycle engine according to claim 6, further comprising an engine body top-bottom direction oil passage extending in a top-bottom direction along a side wall of the cylinder block and a side wall of the cylinder head.

8. The motorcycle engine according to claim 5, further comprising an engine body top-bottom direction oil passage extending in a top-bottom direction along a side wall of the cylinder block and a side wall of the cylinder head.

9. The motorcycle engine according to claim 8, wherein the side wall of the cylinder block and the side wall of the cylinder head are located on an opposite side in the right-left direction relative to the second side wall.

10. The motorcycle engine according to claim 5, further comprising an engine body top-bottom direction oil passage extending in a top-bottom direction along a side wall of the cylinder block and a side wall of the cylinder head.

* * * * *